US008128202B2

(12) United States Patent
Matsuo et al.

(10) Patent No.: US 8,128,202 B2
(45) Date of Patent: Mar. 6, 2012

(54) NOZZLE PLATE, METHOD FOR MANUFACTURING NOZZLE PLATE, DROPLET DISCHARGE HEAD, AND DROPLET DISCHARGE DEVICE

(75) Inventors: Yasuhide Matsuo, Matsumoto (JP); Kenji Otsuka, Suwa (JP); Kazuo Higuchi, Shimosuwa (JP); Kosuke Wakamatsu, Suwa-shi (JP)

(73) Assignee: Seiko Epson Corporation (JP)

( * ) Notice: Subject to any disclaimer, the term of this patent is extended or adjusted under 35 U.S.C. 154(b) by 360 days.

(21) Appl. No.: 12/507,947

(22) Filed: Jul. 23, 2009

(65) Prior Publication Data

US 2010/0026760 A1 Feb. 4, 2010

(30) Foreign Application Priority Data

Jul. 29, 2008 (JP) ..... 2008-194505

(51) Int. Cl.
*B41J 2/135* (2006.01)

(52) U.S. Cl. ..... 347/45; 347/47

(58) Field of Classification Search ..... 347/40, 347/45–47, 64, 65–71
See application file for complete search history.

(56) References Cited

U.S. PATENT DOCUMENTS

| | | | | |
|---|---|---|---|---|
| 5,968,642 | A | 10/1999 | Saito | |
| 7,182,433 | B2 * | 2/2007 | Ishizuka et al. | 347/47 |
| 7,232,206 | B2 * | 6/2007 | Sasaki et al. | 347/45 |
| 7,516,549 | B2 * | 4/2009 | Asuke | 29/890.1 |

FOREIGN PATENT DOCUMENTS

| | | |
|---|---|---|
| JP | 05-155017 | 6/1993 |
| JP | 07-228822 | 8/1995 |
| JP | 2005-246707 | 9/2005 |
| JP | 2006-212971 | 8/2006 |
| JP | 2007-106050 | 4/2007 |
| JP | 2008-105334 | 5/2008 |
| JP | 2008-307873 | 12/2008 |

* cited by examiner

*Primary Examiner* — Thinh Nguyen
(74) *Attorney, Agent, or Firm* — Harness, Dickey & Pierce, P.L.C.

(57) ABSTRACT

A nozzle plate includes: a nozzle for discharging a liquid as droplets; a liquid-repellent film suppressing attachment of the droplets on one surface of the nozzle plate; and a first bonding film formed on the other surface of the nozzle plate and bonded with a substrate. In the nozzle plate, the liquid-repellent film includes a first plasma polymerized film having a Si skeleton, which includes a siloxane (Si—O) bond and has a random atomic structure, and an elimination group bonded with the Si skeleton.

29 Claims, 12 Drawing Sheets

A-A LINE SECTIONAL VIEW

NOZZLE PLATE, METHOD FOR MANUFACTURING NOZZLE PLATE, DROPLET DISCHARGE HEAD, AND DROPLET DISCHARGE DEVICE

The entire disclosure of Japanese Patent Application No. 2008-194505, filed Jul. 29, 2008 expressly incorporated by reference herein.

BACKGROUND

1. Technical Field

The present invention relates to a nozzle plate, a method for manufacturing a nozzle plate, a droplet discharge head, and a droplet discharge device.

2. Related Art

A droplet discharge device such as an ink-jet printer is commonly provided with a droplet discharge head for discharging droplets. Such a droplet discharge head is known that is provided with a nozzle plate having nozzles (nozzle holes) for discharging an ink as droplets; an ink chamber (cavity) storing the ink therein; and a piezoelectric element deforming a wall of the ink chamber so as to discharge droplets of the ink from the nozzles.

If an ink is attached to a surface of the nozzle plate (a surface positioned at a side from which the ink is discharged) in such the droplet discharge head, an ink which is discharged afterward is influenced by a surface tension, a viscosity, or the like of the ink that has been attached on the surface of the nozzle plate and discharge failure (a phenomenon in which a discharge path of the ink is curved) of the ink occurs. As a result, the ink can not be stably discharged on predetermined positions, thus degrading printing quality. Therefore, a liquid-repellent treatment for preventing attachment of an ink is commonly performed on a surface of a nozzle plate, as disclosed in JP-A-7-228822, as a first example.

Here, such the droplet discharge head is assembled by bonding the nozzle plate and a substrate for forming an ink chamber by a photosensitive adhesive or an elastic adhesive, as disclosed in JP-A-5-155017 as a second example.

However, it is very difficult to precisely control a supply amount of the adhesive in supplying the adhesive between the nozzle plate and the substrate. Therefore, uniform amount of the adhesive can not be supplied, making a distance between the nozzle plate and the substrate uneven. Accordingly, uniform bulks can not be achieved among a plurality of ink chambers formed in a droplet discharge head, or uniform bulks of ink chambers can not be achieved among droplet discharge heads. Further, a distance of the droplet discharge head and a printing medium such as a printing sheet becomes uneven. Furthermore, the adhesive may disadvantageously run out of the bonding part. These problems degrade dimensional accuracy of the droplet discharge head. As a result, even though the discharge failure of the ink droplets is suppressed by the liquid-repellent treatment performed on the surface of the nozzle plate, the printing quality of the ink-jet printer can not be sufficiently improved.

SUMMARY

An advantage of the present invention is to provide a nozzle plate that achieves long periods of high quality printing when it is applied to a droplet discharge head; a method for manufacturing such a nozzle plate; a droplet discharge head that exhibits excellent dimensional accuracy and achieves long periods of high quality printing so as to be reliable; and a droplet discharge device that is provided with such a droplet discharge head so as to be reliable.

The advantage above is achieved by the following aspects of the invention.

A nozzle plate according to a first aspect of the invention includes: a nozzle for discharging a liquidliquid as droplets; a liquid-repellent film suppressing attachment of the droplets on one surface of the nozzle plate; and a first bonding film formed on the other surface of the nozzle plate and bonded with a substrate. In the nozzle plate, the liquid-repellent film includes a first plasma polymerized film having a Si skeleton, which includes a siloxane (Si—O) bond and has a random atomic structure, and an elimination group bonded with the Si skeleton. The elimination group existing around a surface of the first plasma polymerized film is eliminated from the Si skeleton by applying energy to a region of at least a part of the first plasma polymerized film so as to generate reactivity, on the region of the first plasma polymerized film, with a coupling agent having liquid repellency with respect to the droplets, and the first plasma polymerized film is bonded with the coupling agent by the reactivity so as to form the liquid-repellent film. The first bonding film is a second plasma polymerized film having a Si skeleton, which includes a siloxane (Si—O) bond and has a random atomic structure, and an elimination group bonded with the Si skeleton. The elimination group existing around a surface of the second plasma polymerized film constituting the first bonding film is eliminated from the Si skeleton by applying energy to a region of at least a part of the second polymerized film, so as to develop in the region of the surface of the second polymerized film adhesiveness with respect to the substrate.

Accordingly, such nozzle plate can be obtained that ensures long periods of high quality printing in a case where the nozzle plate is applied to a droplet discharge head.

In the nozzle plate of the first aspect, it is preferable that a sum of a content of a Si atom and a content of an O atom in whole atoms constituting the first and second plasma polymerized films excluding a H atom be from 10 atomic % to 90 atomic %.

Accordingly, the Si atom and the O atom form a strong network in the first and second plasma polymerized films, further strengthening the first and second plasma polymerized films. Thereby, the nozzle plate can be strongly bonded to the substrate with the first bonding film interposed. Further, the liquid-repellent film obtains excellent durability so as to maintain excellent liquid repellency with respect to the liquidliquid for long periods of time.

In the nozzle plate of the first aspect, it is preferable that an abundance ratio between the Si atom and the O atom in the first and second plasma polymerized films be from 3:7 to 7:3.

Thereby, stability of the first and second plasma polymerized films is enhanced. Accordingly, the nozzle plate can be more strongly bonded to the substrate with the first bonding film interposed, and the coupling agent is securely prevented from separating from the first plasma polymerized film which is included in the liquid-repellent film, thus improving the liquid repellency of the liquid-repellent film with respect to the liquidliquid.

In the nozzle plate of the first aspect, it is preferable that crystallinity of the Si skeleton be equal to or less than 45%.

Due to such crystallinity, the Si skeleton has a sufficiently random atomic structure. Thereby, the property of the Si skeleton becomes prominent, enhancing dimensional accuracy of the first and second plasma polymerized films. Further, the first bonding film composed of the second plasma polymerized film develops more excellent adhesiveness.

In the nozzle plate of the first aspect, it is preferable that the first and second plasma polymerized films include a Si—H bond.

The Si—H bond inhibits regular production of the siloxane bond. Therefore, the siloxane bond is produced in a manner to circumvent the Si—H bond, degrading regularity of the Si skeleton. Thus, when the Si—H bond is included in the first and second plasma polymerized films, the Si skeleton having low crystallinity can be efficiently produced. As a result, the first bonding film composed of the second plasma polymerized film develops more excellent adhesiveness.

In the nozzle plate of the first aspect, when peak intensity attributed to the siloxane bond is set to be 1 in infrared absorbing spectrum of the first and second plasma polymerized films including the Si—H bond, it is preferable that peak intensity attributed to the Si—H bond be from 0.001 to 0.2.

Accordingly, the first and second plasma polymerized films obtain the relatively most random atomic structure. Thereby, the first bonding film composed of the second plasma polymerized film develops more excellent adhesiveness. Further, the first and second plasma polymerized films obtain particularly high chemical resistance.

In the nozzle plate of the first aspect, it is preferable that the elimination group be at least one selected from a H atom, a B atom, a C atom, a N atom, an O atom, a P atom, a S atom, a halogen atom, and an atom group including these atoms that are arranged so as to be bonded with the Si skeleton.

These elimination groups have respectively excellent selectivity of bonding/eliminating by an application of energy. Therefore, such the elimination groups enhance adhesiveness of the first bonding film. Further, the first plasma polymerized film is securely bonded with the coupling agent, whereby the liquid-repellent film obtains excellent liquid repellency with respect to the liquidliquid.

In the nozzle plate of the first aspect, it is preferable that the elimination group be an alkyl group.

The alkyl group has high chemical stability, so that the first and second plasma polymerized films including the alkyl group as the elimination group have excellent weather resistance and chemical resistance.

In the nozzle plate according to the first aspect, when peak intensity attributed to the siloxane bond is set to be 1 in infrared absorbing spectrum of the first and second plasma polymerized films including a methyl group as the elimination group, it is preferable that peak intensity attributed to the methyl group be from 0.05 to 0.45.

Thereby, a content of the methyl group is optimized, so that the methyl group is prevented from excessively inhibiting production of the siloxane bond and therefore necessary and sufficient number of activation hands are produced in the first and second plasma polymerized films. Accordingly, sufficient adhesiveness is developed on the first bonding film, and sufficient amount of the coupling agent is bonded with the first plasma polymerized film included in the liquid-repellent film. Further, the first and second plasma polymerized films obtain sufficient weather resistance and chemical resistance attributed to the methyl group.

In the nozzle plate of the first aspect, it is preferable that the first and second plasma polymerized films be mainly made of polyorganosiloxane.

Accordingly, the first and second plasma polymerized films obtain excellent mechanical property. Thereby, the first bonding film strongly bonds the nozzle plate and the substrate, and the liquid-repellent film has excellent durability and maintains its liquid repellency for long periods of time.

In the nozzle plate of the first aspect, it is preferable that polyorganosiloxane mainly contain a polymeric substance of octamethyltrislioxane.

Accordingly, the nozzle plate and the substrate are more strongly bonded to each other with the first bonding film interposed, and the liquid-repellent film obtains especially excellent liquid repellency with respect to the liquidliquid.

In the nozzle plate of the first aspect, it is preferable that an average thickness of the first and second plasma polymerized films be from 1 nm to 1000 nm.

With this thickness, the substrate and the nozzle plate can be further strongly bonded to each other without seriously degrading the dimensional accuracy therebetween.

In the nozzle plate of the first aspect, it is preferable that the coupling agent be a silane coupling agent including a functional group having liquid repellency.

Accordingly, the first plasma polymerized film included in the liquid-repellent film is more strongly bonded with the silane coupling agent, highly improving durability of the liquid-repellent film.

In the nozzle plate of the first aspect, it is preferable that the nozzle plate be mainly made of one of a silicon material and stainless steel.

These materials have excellent chemical resistance. Therefore, even if the nozzle plate is exposed to the liquidliquid for long periods of time, alteration and deterioration of the nozzle plate can be securely prevented. Further, these materials have excellent proccessability. Therefore, in a case where such the nozzle plate is applied to a droplet discharge head, the droplet discharge head can obtain especially high dimensional accuracy. Accordingly, bulk accuracy of a liquidliquid storage chamber is improved, enabling high quality printing.

A method, according to a second aspect, for manufacturing the nozzle plate of the first aspect includes: a) forming the first and second plasma polymerized films having the Si skeleton, which includes the siloxane (Si—O) bond and has the random atomic structure, and the elimination group bonded with the Si skeleton, on both surfaces of a plate-like base member by employing a plasma polymerization method; b) applying energy to the first plasma polymerized film formed on one surface of the base member, so as to develop reactivity with the coupling agent on the surface of the first plasma polymerized film formed on the one surface of the base member; c) bonding the coupling agent with the first plasma polymerized film formed on the one surface of the base member; and d) forming a nozzle penetrating through the base member and the first and second plasma polymerized films.

Accordingly, the nozzle plate that has high dimensional accuracy and ensures long periods of high quality printing when it is applied to a droplet discharge head can be efficiently obtained.

In the method of the second aspect, it is preferable that the first and second plasma polymerized films be simultaneously formed on the both surfaces of the base member.

This simplifies a manufacturing process of the nozzle plate.

In the method of the second aspect, it is preferable that the first plasma polymerized film that is formed on the one surface of the base member be immersed in a solution containing the coupling agent so as to bond the coupling agent with the one surface of the first plasma polymerized film.

Accordingly, the silane coupling agent can be evenly bonded with the surface of the first plasma polymerized film.

In the method of the second aspect, it is preferable that an output density of high frequency power in generation of plasma by the plasma polymerization method be from 0.01 $W/cm^2$ to 100 $W/cm^2$.

This prevents an excessive application of plasma energy, which is caused by excessively high output density of the high frequency power, with respect to a raw gas, and enables secure formation of the Si skeleton having a random atomic structure.

In the method of the second aspect, it is preferable that the application of energy be conducted by irradiating the first and second plasma polymerized films with an energy beam.

Accordingly, energy can be applied to the first and second plasma polymerized films relatively easily and efficiently.

In the method of the second aspect, it is preferable that the energy beam be ultraviolet light having a wavelength from 126 nm to 300 nm.

Accordingly, an amount of energy to be applied is optimized, so that the Si skeleton in the first and second plasma polymerized films is prevented from being excessively destroyed, and bonds between the Si skeleton and the elimination group can be selectively cleaved. Thereby, the adhesiveness can be developed on the first bonding film while preventing degradation of properties (a mechanical property and a chemical property) of the second plasma polymerized film, and the reactivity with respect to the silane coupling agent can be securely developed on the first plasma polymerized film included in the liquid-repellent film.

In the method of the second aspect, it is preferable that a surface treatment for enhancing adhesion property with respect to the first and second plasma polymerized films be performed in advance on regions, on which the first and second plasma polymerized films are formed, of the base member.

Due to the surface treatment, the adhesion property between the base member and the first and second plasma polymerized films can be enhanced, and therefore, a droplet discharge head having especially excellent dimensional accuracy can be obtained when the nozzle plate is applied to the droplet discharge head.

In the method of the second aspect, it is preferable that the surface treatment be a plasma treatment.

Accordingly, the surfaces of the nozzle plate can be especially optimized for formation of the first and second plasma polymerized films.

A droplet discharge head according to a third aspect of the invention includes: the nozzle plate of the first aspect; and a bonded body obtained by bonding a substrate on which a liquidliquid storage chamber for storing the liquidliquid is formed and a sealing plate formed to cover the liquidliquid storage chamber. In the head, the elimination group existing around the surface of the first bonding film is eliminated from the Si skeleton by applying energy to a region of at least a part of the first bonding film formed on one surface of the nozzle plate, so as to develop adhesiveness at the region of the surface of the first bonding film, and by the adhesiveness, the nozzle plate and the substrate of the bonded body are bonded to each other with the first bonding film interposed.

Accordingly, the droplet discharge head that has excellent dimensional accuracy and secures long periods of high quality printing can be obtained.

In the droplet discharge head of the third aspect, it is preferable that the bonded body be obtained by bonding the substrate and the sealing plate in a manner to interpose a second bonding film similar to the first bonding film.

Accordingly, liquid tightness of the liquidliquid storage chamber and dimensional stability of the droplet discharge head are further improved. As a result, the droplet discharge head that secures long periods of high quality printing can be obtained.

In the droplet discharge head of the third aspect, it is preferable that the sealing plate be a layered body obtained by layering a plurality of layers, and at least one pair of adjacent layers among the layers of the layered body are bonded to each other in a manner to interpose a third bonding film similar to the first bonding film on which the adhesiveness is developed.

This improves adhesion property and transmission capability of distortion between the layers. Therefore, distortion of a vibrating unit can be securely converted into pressure change within the liquidliquid storage chamber. That is, response of displacement of the sealing plate can be improved.

The droplet discharge head of the third aspect further includes: a vibrating unit vibrating the sealing plate and formed on a surface, which is opposite to a surface facing the substrate, of the sealing plate. In the head, it is preferable that the sealing plate and the vibrating unit be bonded to each other in a manner to interpose a fourth bonding film similar to the first bonding film on which the adhesiveness is developed.

This improves adhesion property and transmission capability of distortion between the sealing plate and the vibrating unit. As a result, distortion generated by the vibrating unit can be securely converted into pressure change within the liquidliquid storage chamber.

In the droplet discharge head of the third aspect, it is preferable that the vibrating unit be a piezoelectric element.

Accordingly, degree of flexure generated in the sealing plate can be easily controlled. Thereby, the size of the droplets of the liquidliquid can be easily controlled. As a result, the droplet discharge head capable of highly precise printing is obtained.

The droplet discharge head of the third aspect further includes: a case head formed on the surface, which is opposite to the surface facing the substrate, of the sealing plate. In the head, it is preferable that the sealing plate and the case head be bonded to each other in a manner to interpose a fifth bonding film similar to the first bonding film on which the adhesiveness is developed.

Accordingly, adhesion property between the sealing plate and the case head is improved. As a result, the case head securely supports the sealing plate and therefore, distortion or warpage of the sealing plate, the substrate, and the nozzle plate can be securely prevented.

A droplet discharge device according to a fourth aspect is provided with the droplet discharge head of the third aspect.

Thereby, the droplet discharge device exhibiting high reliability can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

A nozzle plate, a method for manufacturing a nozzle plate, a droplet discharge head, and a droplet discharge device will be described below in detail based on preferred embodiments of the invention with reference to the accompanying drawings.

First Embodiment

Ink-Jet Type Recording Head

A case where a droplet discharge head provided with a nozzle plate according to a first embodiment of the invention is applied as an ink-jet type recording head will now be described.

Figure 1:
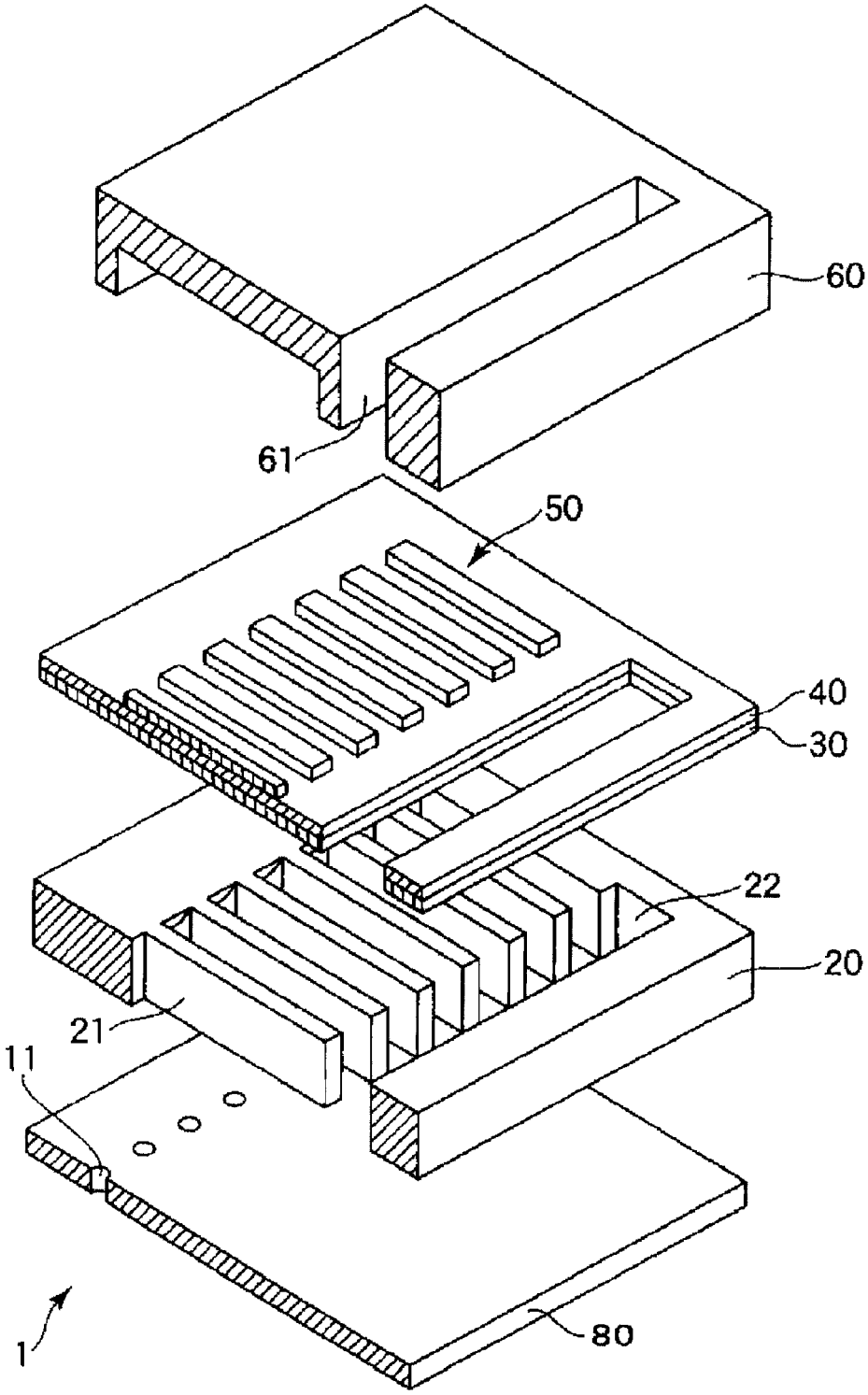
FIG. 1 is an exploded perspective view showing a preferred embodiment of a case where a droplet discharge head of the invention is applied to an ink-jet type recording head.
Figure 2A:
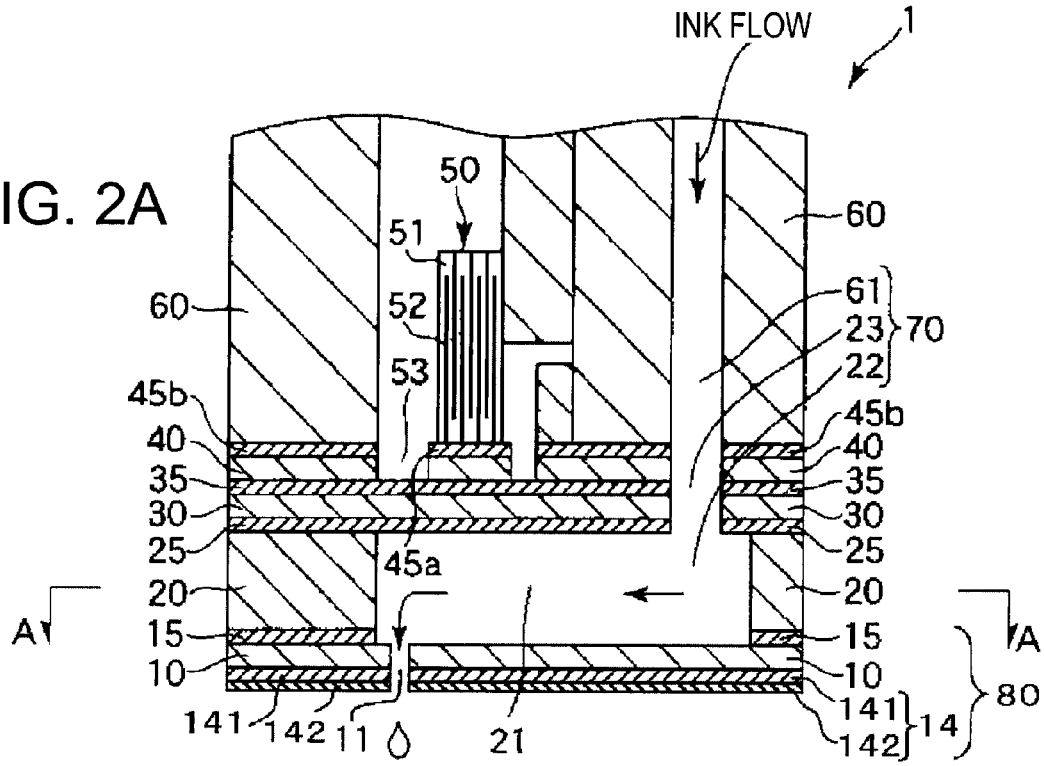
FIGS. 2A and 2B are respectively a longitudinal sectional view showing the ink-jet type recording head of FIG. 1 and a sectional view taken along the A-A line of FIG. 2A.
Figure 2B:
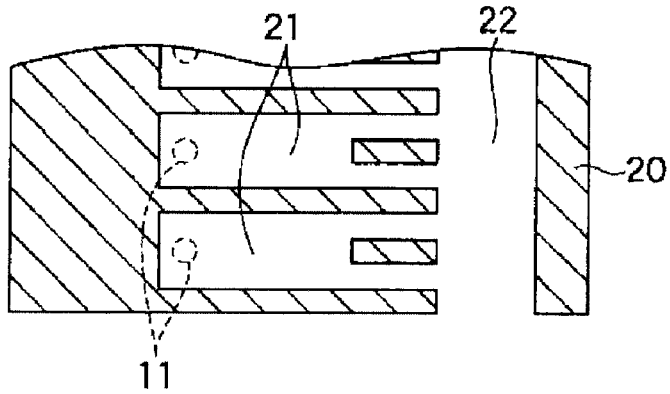
Figure 3:
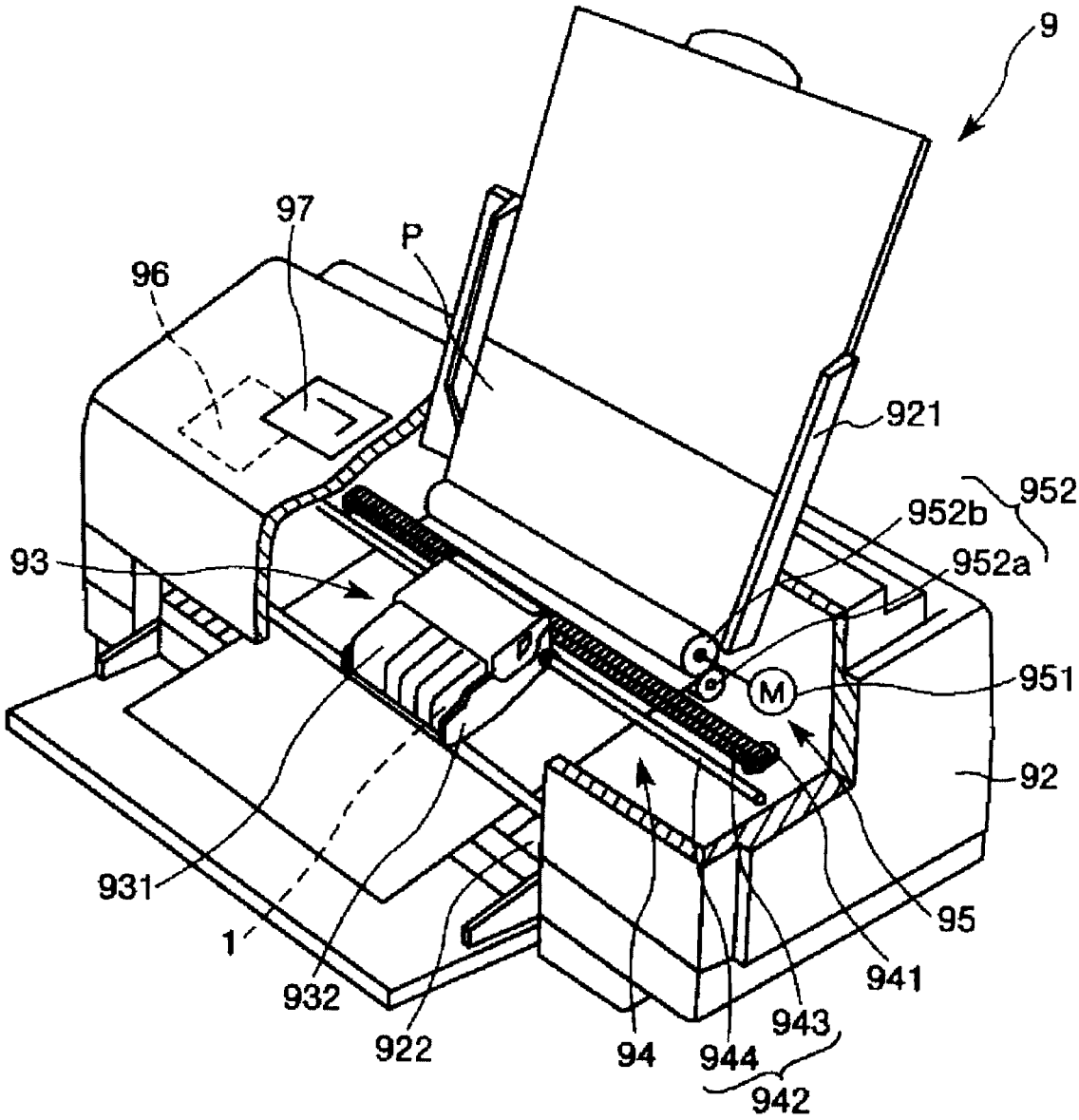
FIG. 3 is a schematic view showing an embodiment of an ink-jet printer including the ink-jet type recording head shown in FIG. 1.
Figure 4:
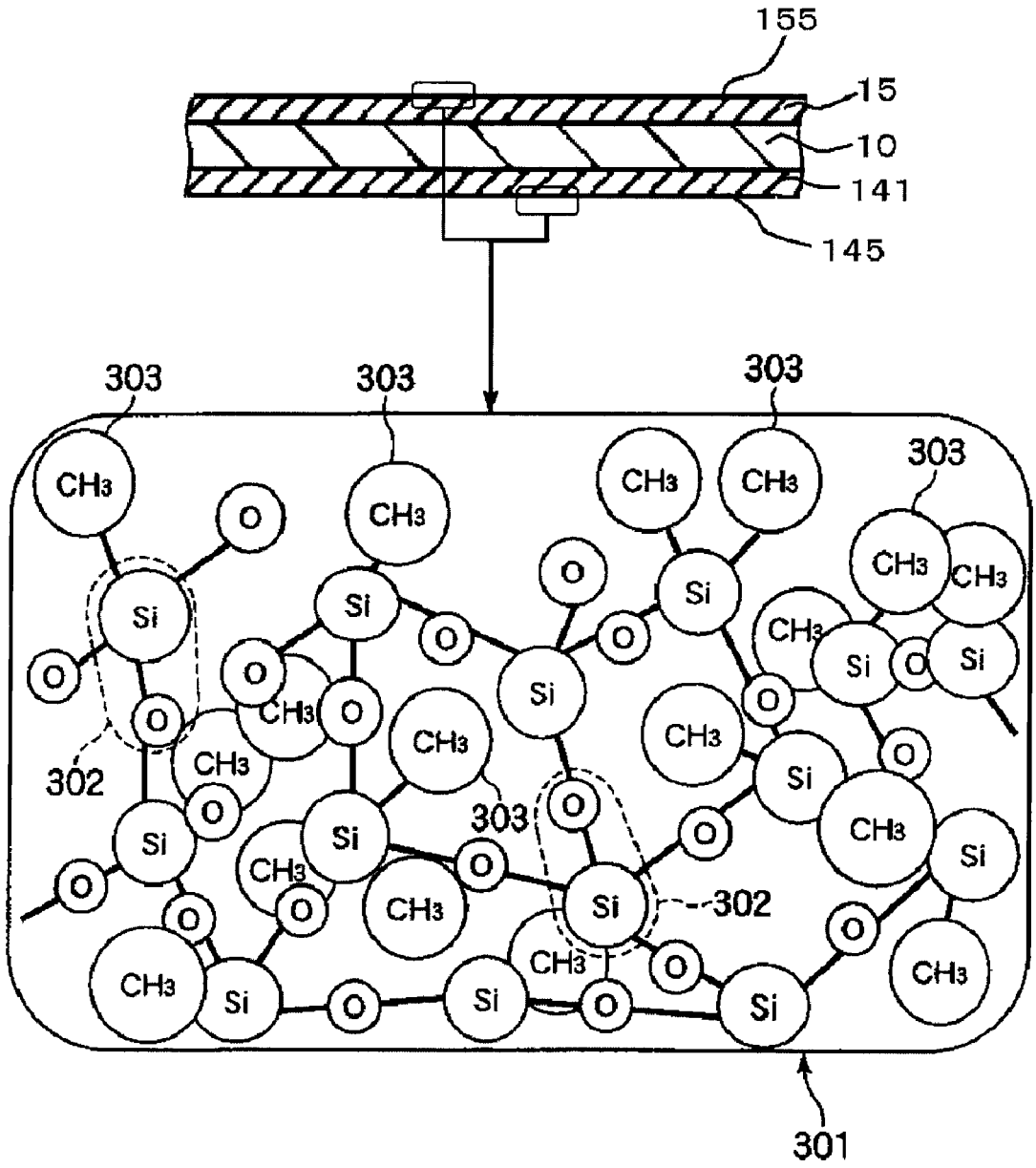
FIG. 4 is a partially enlarged view showing a state of a plasma polymerized film formed on a nozzle plate of the ink-jet type recording head shown in FIGS. 2A and 2B before an application of energy.
Figure 5:
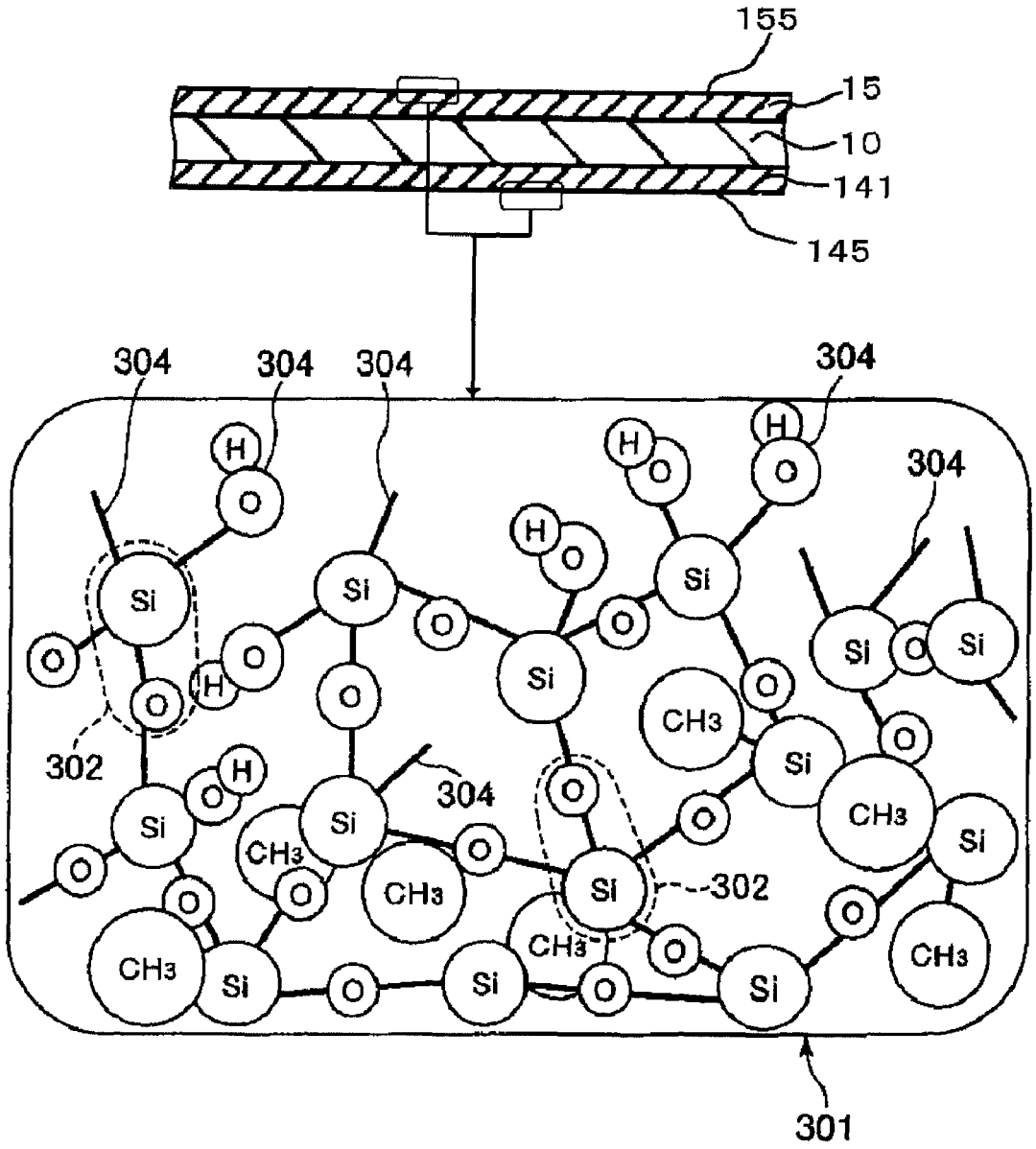
FIG. 5 is a partially enlarged view showing a state of the plasma polymerized film formed on the nozzle plate of the ink-jet type recording head shown in FIGS. 2A and 2B after an application of energy.

FIG. 1 is an exploded perspective view showing a preferred embodiment of a case where a droplet discharge head according to the invention is applied to an ink-jet type recording head. FIGS. 2A and 2B are respectively a longitudinal sectional view showing the ink-jet type recording head of FIG. 1 and a sectional view taken along the A-A line of FIG. 2A. FIG. 3 is a schematic view showing an embodiment of an ink-jet printer provided with the ink-jet type recording head of FIG. 1. FIG. 4 is a partially enlarged view showing a state of a plasma polymerized film formed on a nozzle plate of the ink-jet type recording head shown in FIGS. 2A and 2B before energy is applied. FIG. 5 is a partially enlarged view showing a state of the plasma polymerized film formed on the nozzle plate of the ink-jet type recording head shown in FIGS. 2A and 2B after energy is applied. Note that the upper side of FIGS. 1 to 4 is referred to as "upper" and the lower side of the same is referred to as "lower" in the following descriptions.

An ink-jet type recording head 1 shown in FIG. 1 (hereinafter, referred to as merely a head 1) is mounted on an ink-jet printer (a droplet discharge device according to the invention) 9 shown in FIG. 3.

The ink-jet printer 9 shown in FIG. 3 includes a device body 92; a tray 921 for placing a record paper P at an upper rear; a paper discharging port 922 for discharging the record paper P toward lower front; and an operation panel 97 on an upper surface.

For example, the operation panel 97 includes a display section (not shown) composed of a liquid crystal display, an organic EL display, an LED lamp, or the like and displaying an error message and the like, and an operating section (not shown) composed of various kinds of switches and the like.

Inside the device body 92 are mainly provided a printing device (a printing unit) 94 having a reciprocating head unit 93, a paper feeding device (a paper feeding unit) 95 feeding each sheet of the record paper P into the printing device 94, and a controlling section (a controlling unit) 96 controlling the printing device 94 and the paper feeding device 95.

The controlling section 96 controls the paper feeding device 95 to intermittently feed each sheet of the recording paper P. The recording paper P passes through near a lower part of the head unit 93. During the passing of the record paper P, the head unit 93 reciprocates in a direction approximately orthogonal to a direction for feeding the record paper P to perform printing on the record paper P. In short, ink-jet printing is performed in a manner that reciprocation of the head unit 93 and the intermittent feeding of the record paper P correspond to main scanning and sub-scanning respectively in a printing operation.

The printing device 94 includes the head unit 93, a carriage motor 941 as a driving source for the head unit 93, and a reciprocation mechanism 942 reciprocating the head unit 93 corresponding to rotation of the carriage motor 941.

The head unit 93 includes the head 1 having a large number of nozzles 11 at a lower portion thereof, an ink cartridge 931 for supplying ink to the head 1; and a carriage 932 on which the head 1 and the ink cartridge 931 are mounted.

Here, the ink cartridge 931 includes four color (yellow, cyan, magenta, and black) ink cartridges, enabling full-color printing.

The reciprocation mechanism 942 includes a carriage guiding shaft 943 having end portions supported by a frame (not shown) and a timing belt 944 extending in parallel to the carriage guiding shaft 943.

The carriage 932 is reciprocatably supported by the carriage guiding shaft 943 and fixed to a part of the timing belt 944.

With operation of the carriage motor 941, the timing belt 944 runs forward and backward via pulleys, whereby the head unit 93 is guided by the carriage guiding shaft 943 to perform reciprocating motion. During the reciprocation, the head 1 discharges ink according to need to perform printing on the record paper P.

The paper feeding device 95 includes a paper feeding motor 951 and a paper feeding roller 952 rotating in a manner to correspond to operation of the paper feeding motor 951.

The paper feeding roller 952 is composed of a driven roller 952*a* and a driving roller 952*b* that are disposed at lower and upper positions to be opposed to each other in a manner to sandwich a feed channel of the record paper P (sandwiching the record paper P), and the driving roller 952*b* is coupled to the paper feeding motor 951. By this structure, the paper feeding roller 952 feeds each of multiple sheets of the record paper P set in the tray 921 to the printing device 94. Instead of the tray 921, a paper feeding cassette containing the record paper P may be removably attached.

The controlling section 96 controls the printing device 94, the paper feeding device 95, and the like based on printing data inputted from a host computer such as a personal computer or a digital camera, for performing printing.

The controlling section 96 mainly includes a memory storing control programs, by which respective sections are controlled, and the like; a driving circuit driving the printing device 94 (the carriage motor 941); a driving circuit driving the paper feeding device 95 (the paper feeding motor 951); a communication circuit acquiring the printing data from the host computer; and a CPU electrically coupled to these components to execute various kinds of controls at the respective sections, although the components are not shown in the drawing.

In addition, the CPU is electrically coupled to various kinds of sensors capable of detecting an amount of ink left in each of the ink cartridges 931 and a position of the head unit 93, for example.

The controlling section 96 acquires the printing data via the communication circuit to store the data in the memory. The CPU processes the printing data to output a driving signal to each of the driving circuits based on the processed data and input data from the sensors. The printing device 94 and the paper feeding device 95 respectively operate based on the driving signal. Thus, the printing is performed on the record paper P.

Hereinafter, the head 1 will be described in detail with reference to FIGS. 1 to 2B.

As shown in FIGS. 1 to 2B, the head 1 includes a nozzle plate 80; a liquidliquid storage chamber forming substrate (substrate) 20; a sealing sheet 30; a vibrating plate 40 provided on the sealing sheet 30; a piezoelectric element (vibrating unit) 50 provided on the vibrating plate 40; and a case head 60 also provided on the vibrating plate 40. Here, in the embodiment, the sealing sheet 30 and the vibrating plate 40 form a sealing plate. The head 1 is a piezo-jet type head.

The liquidliquid storage chamber forming substrate 20 (hereinafter, referred to as a substrate 20 in an abbreviated form) includes a plurality of liquidliquid storage chambers (pressure chambers) 21 storing the ink therein and a liquidliquid supply chamber 22 communicating with the liquidliquid storage chambers 21 and supplying the ink to each of the liquidliquid storage chambers 21.

As shown in FIGS. 1 to 2B, each of the liquidliquid storage chambers 21 and the liquidliquid supply chamber 22 has a nearly rectangular shape in a planar view, and a width (a short side) of each of the liquidliquid storage chambers 21 is smaller than a width (a short side) of the liquidliquid supply chamber 22.

Further, each of the liquidliquid storage chambers 21 is disposed approximately orthogonal to the liquidliquid supply chamber 22, that is, the whole of the liquidliquid storage chambers 21 and the liquidliquid supply chamber 22 form a comb shape in a planar view.

Here, the liquidliquid supply chamber 22 may have a trapezoidal shape, a triangular shape, or a barrel-shape (capsule-shape) in a planar view instead of the rectangular shape of the embodiment.

Examples of a material of the substrate 20 includes: silicon materials such as monocrystalline silicon, multicrystalline silicon, and amorphous silicon; metal materials such as stainless steel, titanium, and aluminum; glass materials such as quartz glass, silicate glass (quartz glass), alkaline silicate glass, soda-lime glass, potash lime glass, lead (alkaline) glass, barium glass, and borosilicate glass; ceramic materials such as alumina, zirconia, ferrite, silicon nitride, aluminum nitride, boron nitride, titanium nitride, silicon carbide, boron carbide, titanium carbide, and tungsten carbide; carbon materials such as graphite; polyethylene; polypropylene; ethylene-propylene copolymer; polyolefin such as ethylene-vinyl acetate copolymer (EVA); cyclic polyolefin; modified polyolefin; polyvinyl chloride; polyvinylidene chloride; polystyrene; polyamide; polyimide; polyamide-imide; polycarbonate; poly-(4-methylpentene-1); ionomer; acrylic resin; polymethylmethacrylate; acrylonitrile-butadiene-styrene copolymer (ABS copolymer); acrylonitrile-styrene copolymer (AS resin); butadiene-styrene copolymer; polyoxymethylene; polyvinyl alcohol (PVA); ethylene-vinyl alcohol copolymer (EVOH); polyethylene terephthalate (PET); polyethylene naphthalate; polybutylene terephthalate (PBT); polyester such as polycyclohexane terephthalate (PCT); polyether; polyether ketone (PEK); polyether ether ketone (PEEK); polyetherimide; polyacetal (POM); polyphenylene oxide; modified polyphenylene oxide; modified polyphenylene ether resin (PBO); polysulfone; polyethersulfone; polyphenylene sulfide (PPS); polyarylate; aromatic polyester (liquid crystalline polymer); polytetrafluoroethylene; polyvinylidene-fluoride; other fluorine resin; styrene-, polyolefin-, polyvinyl chloride-, polyurethane-, polyester-, polyamide-, polybutadiene-, trans-polyisoprene-, fluoro-rubber-, and chlorinated polyethylene-thermoplastic elastomers; epoxy resin; phenol resin; urea resin; melamine resin; aramid resin; unsaturated polyester; silicone resin; and polyurethane; or a copolymer, a blended materials, and polymer alloys that mainly contain the above materials. These materials may be used singly, or a complex material obtained by mixing two or more of these materials may be used.

Alternatively, a material obtained by performing an oxidation treatment (forming an oxidized film), a plating treatment, a passivation treatment, or a nitriding treatment with respect to the above material may be used.

Among the above materials, the constituent material of the substrate 20 is preferably silicon materials or stainless steel. These materials have excellent chemical resistance. Therefore, even if the substrate 20 is exposed to an ink for long periods of time, alteration and deterioration of the substrate 20 can be securely prevented. Further, these materials have excellent proccessability, so that the substrate 20 having high dimensional accuracy can be obtained. Accordingly, accuracy of the bulks of the liquidliquid storage chambers 21 and the liquidliquid supply chamber 22 is improved, providing the head 1 that can perform high quality printing.

The liquidliquid supply chamber 22 communicates with a liquidliquid supply path 61 which is formed in the case head 60 described later and constitutes a part of a reservoir 70 serving as an ink chamber which is shared by the plurality of liquidliquid storage chambers 21 and supplies the ink to the chambers 21.

Further, a lyophilic treatment may be performed with respect to inner surfaces of the liquidliquid storage chambers 21 and the liquidliquid supply chamber 22 in advance. This prevents generation of bubbles in the ink stored in the liquidliquid storage chambers 21 and the liquidliquid supply chamber 22.

On a lower surface (a surface opposite to a surface facing the sealing sheet 30) of the substrate 20, the nozzle plate 80 is provided.

The nozzle plate (a nozzle plate according to the invention) 80 includes a nozzle plate body 10 having the nozzles 11, a liquid-repellent film 14 provided on a surface, which is opposite to a surface facing the substrate 20, of the nozzle plate body 10, and a bonding film 15 formed on a surface, which faces the substrate 20, of the nozzle plate body 10. The nozzle plate 80 is bonded (adheres) to the substrate 20 with the bonding film 15 interposed.

The nozzle plate of the invention characteristically has the structure described above.

The bonding film 15 of the nozzle plate 80 is a plasma polymerized film including a Si skeleton including siloxane (Si—O) bonds and having a complex atomic structure, and elimination groups bonded with the Si skeleton.

When energy is applied to the plasma polymerized film, the elimination groups are eliminated from the Si skeleton, developing adhesiveness on the surface of the film. Therefore, the plasma polymerized film formed on a surface, which faces the substrate 20, of the nozzle plate body 10 serves as the bonding film 15 having a function to bond the nozzle plate 10 and the substrate 20 by its adhesiveness which is developed by an application of energy.

On the other hand, the liquid-repellent film 14 of the nozzle plate 80 includes a base film 141 that is a plasma polymerized film like the bonding film 15 and a monomolecular film 142 that is made of a coupling agent having liquid repellency with respect to an ink (hereinafter, also referred to as merely a coupling agent) and formed on a surface, which is an opposite surface to a surface facing the nozzle plate body 10, of the base film 141.

When energy is applied to the plasma polymerized film constituting the base film 141, the elimination groups are eliminated from the Si skeleton, thus developing the adhesiveness on the surface of the polymerized film and also developing reactivity with respect to the coupling agent.

Due to the reactivity, the coupling agent is bonded with a surface of the base film 141 composed of the plasma polymerized film, forming the monomolecular film 142 made of the coupling agent on the base film 141. Thus the liquid-repellent film 14 is formed. By forming such the liquid-repellent film 14 on a surface, which is an opposite surface to a surface facing the substrate 20 (a surface from which an ink is discharged), of the nozzle plate body 10, the droplets of the ink (ink droplets) discharged from the nozzles 11 can be prevented from attaching the nozzle plate 80 (the nozzle plate body 10).

The coupling agent constituting the monomolecular film 142 includes a reactive functional group bonded to the surface, on which reactivity is developed, of the base film 141 and a functional group (a liquid-repellent functional group) having liquid repellency with respect to an ink.

Examples of the liquid-repellent functional group include a fluoroalkyl group, an alkyl group, a carboxyl group, a hydroxyl group, an epoxy group, an amino group, a mercapto group, an isocyanate group, and a sulfide group, or a group containing these groups (an alkyl group terminated by these groups, for example).

Especially, in a case of using an ink containing an organic component such as resin dispersant (dispersed resin, dispersant, and the like for dispersing pigment in a pigment ink, for example), the liquid-repellent functional group preferably contains a long-chain alkyl group. The liquid-repellent functional group including the long-chain alkyl group has excellent oil repellency with respect to an organic component such as resin dispersant compared to a liquid-repellent functional group including an alkyl group such as a methyl group and an ethyl group (or an alkyl group such as a methyl group and an ethyl group which are terminated by functional groups mentioned above). Therefore, the monomolecular film 142 made of a silane coupling agent having such liquid-repellent functional group can securely prevent attachment of the organic component contained in an ink to the liquid-repellent film 14 (the nozzle plate body 10).

In contrast, in a case where a liquid-repellent functional group including an alkyl group such as a methyl group and an ethyl group having a relatively small number of carbon atoms as a silane coupling agent, sufficient oil repellency with respect to the organic component in the ink can not be given to the monomolecular film 142, whereby the organic component may be disadvantageously attached to the surface of the liquid-repellent film 14.

The long-chain alkyl group of the liquid-repellent functional group preferably has 4 or more of carbon atoms, more preferably has 6 or more of carbon atoms. Accordingly, attachment of the organic component of the ink to the liquid-repellent film 14 (the nozzle plate body 10) can be securely prevented. The silane coupling agent (the monomolecular film 142) having the long-chain alkyl group having the above number of carbon atoms has excellent durability, whereby a long life of the liquid-repellent film 14 is achieved.

As the reactive functional group, various metal alkoxide including Ti, Li, Si, Na, K, Mg, Ca, St, Ba, Al, In, Ge, Bi, Fe, Cu, Y, Zr, Ta, and the like can be adopted. Among these, metal alkoxide including Si, Ti, Al, Zr, and the like is commonly used, but a silane coupling agent (metal alkoxide) including Si is especially preferably used. The silane coupling agent having a molecular structure including a Si atom has an affinity for the plasma polymerized film having the siloxane (Si—O) bonds. Therefore, the silane coupling agent is more strongly bonded with the surface, on which reactivity is developed by an application of energy, of the plasma polymerized film (the base film 141). Accordingly, separation (elimination) of the monomolecular film 142, which is made of the silane coupling agent and formed on the base film 141, from the base film 141 can be more securely prevented or suppressed. Consequently, liquid repellency of the liquid-repellent film 14 is maintained excellent for long periods of time.

For the above-mentioned reason, the silane coupling agent including the liquid-repellent functional group described above is preferably used as the coupling agent.

A structure of the plasma polymerized films (the liquid-repellent film 14 and the bonding film 15) will be described in detail later.

On the nozzle plate body 10, the nozzles 11 are formed (perforated) so as to correspond to the liquidliquid storage chambers 21. The ink stored in the liquidliquid storage chambers 21 is pushed out of the chambers from the nozzles 11, thus being able to discharge the ink as droplets. The liquid-repellent film 14 and the bonding film 15 included in the nozzle plate 80 are formed on the nozzle plate body 10 so as not to cover the nozzles 11 in a planar view.

The nozzle plate body 10 constitutes the bottom surfaces of inner walls of the liquidliquid storage chambers 21 and the liquidliquid supply chamber 22. That is, the nozzle plate body 10, the substrate 20, and the sealing sheet 30 form the liquidliquid storage chambers 21 and the liquidliquid supply chamber 22.

Examples of a material of the nozzle plate body 10 include silicon materials, metal materials, glass materials, ceramic materials, carbon materials, and resin materials mentioned above. These may be used singly, or a complex material obtained by mixing two or more of these materials may be used.

Among the above materials, the constituent material of the nozzle plate body 10 is preferably silicon materials or stainless steel. These materials have excellent chemical resistance. Therefore, even if the nozzle plate body 10 is exposed to an ink for long periods of time, alteration and deterioration of the nozzle plate body 10 can be securely prevented. Further, these materials have excellent proccessability, so that the nozzle plate body 10 having high dimensional accuracy can be obtained. As a result, the head 1 having high reliability can be obtained.

The constituent material of the nozzle plate body 10 preferably has a linear expansion coefficient in a range approximately from $2.5*10^{-6}/°$ C. to $4.5*10^{-6}/°$ C.

Further, the thickness of the nozzle plate body 10 is not particularly limited, but is preferably in a range approximately from 0.01 mm to 1 mm.

Further, the sealing sheet 30 is bonded (adheres) to the top surface of the substrate 20 with a bonding film 25 interposed.

The sealing sheet 30 constitutes the upper surfaces of inner walls of the liquidliquid storage chambers 21 and the liquidliquid supply chamber 22. That is, the sealing sheet 30, the substrate 20, and the nozzle plate body 10 form the liquidliquid storage chambers 21 and the liquidliquid supply chamber 22. The sealing sheet 30 and the substrate 20 are securely bonded to each other, securing liquid tightness of each of the liquidliquid storage chambers 21 and the liquidliquid supply chamber 22.

Examples of a material of the sealing sheet 30 include silicon materials, metal materials, glass materials, ceramic materials, carbon materials, and resin materials mentioned above. These may be used singly, or a complex material obtained by mixing two or more of these materials may be used.

Among these materials, the constituent material of the sealing sheet 30 is preferably resin materials such as polyphenylene sulfide (PPS) and aramid resin, silicon materials, or stainless steel. These materials have excellent chemical resistance. Therefore, even if the sealing sheet 30 is exposed to an ink for long periods of time, alteration and deterioration of the sealing sheet 30 can be securely prevented. Therefore, the ink can be stored in the liquidliquid storage chambers 21 and the liquidliquid supply chamber 22 for long periods of time.

The bonding film 25 bonding the sealing sheet 30 and the substrate 20 may be made of any material as long as the material can bond or adhesively bond the substrate 20 and the sealing sheet 30. Examples of the material of the bonding film 25 include an adhesive such as an epoxy adhesive, a silicone adhesive, and a urethane adhesive; a soldering material; and a brazing material. The material is arbitrarily selected from these depending on the constituent materials of the substrate 20 and the sealing sheet 30.

A bonding film similar to the bonding film 15 described above may be used as the bonding film 25.

Further, the vibrating plate 40 is bonded (adheres) to the top surface of the sealing sheet 30 with a bonding film 35 interposed.

Examples of a material of the vibrating plate 40 include silicon materials, metal materials, glass materials, ceramic materials, carbon materials, and resin materials mentioned above. These may be used singly, or a complex material obtained by mixing two or more of these materials may be used. The vibrating plate 40 and the sealing sheet 30 are securely bonded to each other, enabling secure conversion of distortion occurring in the piezoelectric element 50 into displacement of the sealing sheet 30, that is, bulk change of each of the liquidliquid storage chambers 21.

Among the above materials, the constituent material of the vibrating plate 40 is preferably silicon materials or stainless steel. Such materials can be elastically deformed at high speed. Therefore, when the piezoelectric element 50 displaces the vibrating plate 40, the bulk of the liquidliquid storage chambers 21 can be changed at high speed. As a result, the ink can be discharged with high accuracy.

The bonding film 35 bonding the vibrating plate 40 and the sealing sheet 30 may be made of any material as long as the material can bond or adhesively bond the sealing sheet 30 and the vibrating plate 40. Examples of the material include an adhesive such as an epoxy adhesive, a silicone adhesive, and a urethane adhesive; a soldering material; and a brazing material. The material is arbitrarily selected from these depending on the constituent materials of the sealing sheet 30 and the vibrating plate 40.

A bonding film similar to the bonding film 15 described above may be used as the bonding film 35.

In the embodiment, though the sealing plate is a layered body composed of the sealing sheet 30 and the vibrating plate 40 that are layered, the sealing plate may be a single layer or a layered body having three or more layers.

In a case where the sealing plate is the layered body having three or more layers, if at least one pair of the layers, which are adjacent to each other, of the layered body is bonded to each other with the bonding film 35 interposed, dimensional accuracy of the layered body is improved and further, dimensional accuracy of the head 1 can be improved.

The piezoelectric element (vibrating unit) 50 is bonded (adheres) to a part of the top surface of the vibrating plate 40 (around the center portion of the top surface of the vibrating plate 40 in FIG. 2) with a bonding film 45 interposed.

The piezoelectric element 50 is a layered body composed of piezoelectric layers 51 made of a piezoelectric material and electrode films 52 through which a voltage is applied to the piezoelectric layers 51. In the piezoelectric element 50, an application of a voltage to the piezoelectric layers 51 through the electrode films 52 generates distortion, which corresponds to the voltage, of the piezoelectric layers 51 (reverse piezoelectric effect). This distortion generates flexure (vibration) of the vibrating plate 40 and the sealing sheet 30 so as to change the bulks of the liquidliquid storage chambers 21. Such secure bonding of the sealing sheet 40 and the vibrating plate 50 enables secure conversion of distortion occurring in the piezoelectric element 50 into displacement of the vibrating plate 40 and the sealing sheet 30, that is, bulk change of each of the liquidliquid storage chambers 21.

A layering direction of the piezoelectric layers 51 and the electrode films 52 is not especially limited. The direction may be parallel to or orthogonal to the vibrating plate 40. In a case where the layering direction of the piezoelectric layers 51 and the electrode films 52 is orthogonal to the vibrating plate 40, the piezoelectric element 50 disposed as this is especially called multi layer piezo (MLP). If the piezoelectric element 50 is MLP, the amount of displacement of the vibrating plate 40 is large. Therefore, an adjustment range of the discharge amount of the ink is advantageously wide.

In the piezoelectric element 50, a surface adjacent to the bonding film 45*a* is either of a surface from which the piezoelectric layers are exposed, a surface from which the electrode films are exposed, and a surface from which both of the piezoelectric layers and the electrode films are exposed, though it changes depending on a disposing way of the piezoelectric element 50.

Examples of a constituent material of the piezoelectric layers 51 of the piezoelectric element 50 include barium titanate, lead zirconate, lead zirconate titanate, zinc oxide, aluminum nitride, lithium tantalate, lithium niobate, and crystal.

On the other hand, examples of a constituent material of the electrode films 52 include various metal materials such as Fe, Ni, Co, Zn, Pt, Au, Ag, Cu, Pd, Al, W, Ti, and Mo, or these alloys.

The bonding film 45*a* bonding the piezoelectric element 50 and the vibrating plate 40 may be made of any material as long as the material can bond or adhesively bond the vibrating plate 40 and the piezoelectric element 50. Examples of the material of the bonding film 45*a* include an adhesive such as an epoxy adhesive, a silicone adhesive, and a urethane adhesive; a soldering material; and a brazing material. The material is arbitrarily selected from these depending on the constituent materials of the vibrating plate 40 and the piezoelectric element 50.

A bonding film similar to the bonding film 15 described above may be used as the bonding film 45*a*.

Here, the vibrating plate 40 described above includes a recessed portion 53 which is formed in a circular fashion so as to surround a position corresponding to the piezoelectric element 50. That is, at the position corresponding to the piezoelectric element 50, a part of the vibrating plate 40 is isolated by the recessed portion 53 in an island fashion.

The bonding film 45*a* is formed at an internal position of the circular shape defined by the recessed portion 53.

The electrode films 52 of the piezoelectric element 50 are electrically connected with a driving IC which is not shown. Due to the connection, operations of the piezoelectric element 50 can be controlled by the driving IC.

Further, the case head 60 is bonded (adheres) to a part of the top surface of the vibrating plate 40 with a bonding film 45*b* interposed. Such secure bonding of the case head 60 and the vibrating plate 40 reinforces a cavity portion formed by a layered body composed of the nozzle plate 10, the substrate 20, the sealing sheet 30, and the vibrating plate 40 and securely suppresses buckle, warpage, or the like of the cavity portion.

Examples of a material of the case head 60 include silicon materials, metal materials, glass materials, ceramic materials, carbon materials, and resin materials mentioned above. These may be used singly, or a complex material obtained by mixing two or more of these materials may be used.

Among these materials, the constituent material of the case head 60 is preferably modified polyphenylene ether resin such as polyphenylene sulfide (PPS) and Zylon (registered brand), or stainless steel. These materials have sufficient rigidity so as to be favorably used as the constituent material of the case head 60 which supports the head 1.

The bonding film 45*b* bonding the case head 60 and the vibrating plate 40 may be made of any material as long as the material can bond or adhesively bond the vibrating plate 40 and the case head 60. Examples of the material of the bonding film 45*b* include an adhesive such as an epoxy adhesive, a silicone adhesive, and a urethane adhesive; a soldering material; and a brazing material. The material is arbitrarily selected from these depending on the constituent materials of the vibrating plate 40 and the case head 60.

A bonding film similar to the bonding film 15 described above may be used as the bonding film 45*b*.

The bonding film 25, the sealing sheet 30, the bonding film 35, the vibrating plate 40, and the bonding film 45*b* have a through hole 23 at a position corresponding to the liquid supply chamber 22. By the through hole 23, the liquid supply path 61 formed in the case head 60 and the liquid supply chamber 22 are communicated with each other. Together with the liquid supply path 61 and the liquid supply chamber 22, the through hole 23 constitutes the reservoir 70 serving as the ink chamber which is shared by the plurality of liquid storage chambers 21 and supplies the ink to the chambers 21.

Such the head 1 takes the ink therein from an external liquid supply unit which is not shown, fills throughout the inside from the reservoir 70 to the nozzles 11 with the ink, and subsequently operates the piezoelectric element 50 corresponding to each of the liquid storage chambers 21 based on a recording signal from the driving IC. In this manner, flexure (vibration) of the vibrating plate 40 and the sealing sheet 30 is generated due to the reverse piezoelectric effect of the piezoelectric element 50. As a result, when the bulk of each of the liquid storage chambers 21 becomes small, for example, pressure in each of the liquid storage chambers 21 instantaneously rises so as to squeeze (discharge) the ink out of the nozzles 11 as droplets.

Thus, in the head 1, voltage is applied through the driving IC to a piezoelectric element 50 disposed corresponding to a desired printing position, that is, a discharge signal is sequentially inputted into the piezoelectric element 50 at the desired printing position, being able to print arbitrary letters or figures.

Here, the head 1 is not limited to have the structure described above, but may have a structure in which a heater is used as the vibrating unit instead of the piezoelectric element 50 (thermal system structure). Such head heats and boils an ink by the heater so as to increase the pressure inside liquid storage chambers, discharging the ink from the nozzles 11 as droplets.

Alternatively, the vibrating unit may have a structure of an electrostatic actuator system and the like.

In a case where the vibrating unit is the piezoelectric element as the embodiment, degree of flexure generated in the vibrating plate 40 and the sealing sheet 30 can be easily controlled. Thus, the size of the ink droplet can be easily controlled.

A structure of the plasma polymerized films (the liquid-repellent film 14 and the bonding film 15) will now be described.

Such plasma polymerized film is formed by plasma polymerization method. As shown in FIG. 4, the plasma polymerized film includes a Si skeleton 301 which includes siloxane (Si—O) bonds 302 and has a random atomic structure, and elimination groups 303 bonded with the Si skeleton 301.

When energy is applied to the plasma polymerized film, part of elimination groups 303 is eliminated from the Si skeleton 301, generating activation hands 304 as shown in FIG. 5. Here, the activation hands are non-bonding hands (dangling bonds) or bonds obtained by terminating the non-bonding hands by hydroxyl groups.

Thus, on the surface on which the activation hands 304 are generated by an application of energy, adhesiveness is developed.

Such plasma polymerized film is a strong film that hardly deforms due to an influence of the Si skeleton 301 including siloxane bonds 302 and having the random atomic structure. This is because of that defects such as dislocation or declination hardly occur at a crystal grain boundary due to a low crystalline property of the Si skeleton 301. Therefore, a distance between the nozzle plate body 10 and the substrate 20 that are bonded with each other in a manner to interpose the bonding film 15 which is composed of such plasma polymerized film can be maintained constant with high dimensional accuracy. Thus a bulk of each of the liquid storage chambers 21 and the liquid supply chamber 22 can be precisely controlled. As a result, the plurality of liquid storage chambers 21 can be formed in the head 1 to have uniform bulks, being able to discharge ink droplets having same sizes as each other from the nozzles 11. Further, a fixing angle of the nozzle plate 80 can be precisely controlled, being able to maintain a discharge direction of ink droplets constant.

The plasma polymerized film is formed by the plasma polymerization method. According to the plasma polymerization method, a plasma polymerized film can be efficiently formed and the finally obtained plasma polymerized film is dense and homogeneous. Accordingly, the bonding film 15 composed of the plasma polymerized film can solidly bonds the nozzle plate body 10 and the substrate 20. Further, in a case where energy is applied to the bonding film 15 formed by the plasma polymerization method, the film 15 can maintain an activated state generated by the application of energy for relatively long periods of time. Therefore, a simpler and more efficient manufacturing process of the head 1 can be achieved.

Bonding the substrate 20 and the nozzle plate body 10 with the bonding film 15 composed of the plasma polymerized film is free from such a problem that an adhesive runs out as related art which uses an adhesive for bonding. Therefore, the adhesive which runs out can be prevented from blocking the flowing path of the ink in the head 1. Also, there is no need for removing the adhesive which runs out.

Further, the plasma polymerized film has excellent chemical resistance due to the influence, described above, of the Si skeleton 301 which is strong. Therefore, even if the bonding film 15 is exposed to the ink for long periods of time, alteration and deterioration of the bonding film 15 are prevented. Accordingly, bonding (adhesion) of the nozzle plate body 10 and the substrate 20 bonded to each other in a manner to interpose the bonding film 15 can be maintained for long periods of time. That is, liquid tightness of the head 1 can be sufficiently maintained by the bonding film 15, achieving the head 1 having high reliability.

Further, the plasma polymerized film has excellent thermal resistance due to an influence of the Si skeleton 301 that is chemically stable. Therefore, even if the head 1 is exposed under high temperature, alteration and deterioration of the bonding film 15 can be securely prevented.

Further, the plasma polymerized film is a solid state film having no liquidity. Therefore, the thickness or the shape of an adhesion layer (the bonding film 15) hardly change compared to related art liquid or mucoid adhesive having liquidity. Accordingly, dimensional accuracy of the head 1 including the bonding film 15 is substantially higher than related art. Furthermore, since the time for curing an adhesive is not required, strong bonding can be achieved in a short period of time.

The activation hands 304 produced on the plasma polymerized film develop the adhesiveness on the plasma polymerized film and have the reactivity with respect to the coupling agent (the reactive functional group included in the coupling agent).

The activation hands 304 are strongly bonded with the coupling agent. Therefore, the monomolecular film 142 made of the coupling agent is hardly separated from the base film 141 composed of the plasma polymerized film, thus being strongly bonded to the base film 141.

By forming the liquid-repellent film 14 composed of the base film 141 and the monomolecular film 142 on a surface, which is an opposite surface to a surface facing the substrate 20, of the nozzle plate body 10, the ink droplets discharged from the nozzles 11 can be securely prevented from attaching the nozzle plate 80 (the nozzle plate body 10). Accordingly, discharge failure of the ink in discharging the ink from the nozzles 11 is securely prevented, being able to stably discharge the ink to desired positions.

The head 1 provided with the nozzle plate 80 having the liquid-repellent film 14 and the bonding film 15 described above has high dimensional accuracy, and occurrence of discharge failure is securely prevented in discharge of the ink. As a result, printing quality of the ink-jet printer 9 can be improved. Further, in a case of manufacturing a plurality of heads 1, variety of printing qualities of the heads 1 can be suppressed, being able to suppress individual difference of the printing qualities of the ink-jet printers 9.

In the composition of the plasma polymerized film, a sum of a Si-atom content rate and an O-atom content rate among all atoms constituting the plasma polymerized film excluding H atoms is preferably in a range approximately from 10 atomic % to 90 atomic %, more preferably in a range approximately from 20 atomic % to 80 atomic %. When Si atoms and O atoms are contained at the content rate of the above range, the Si atoms and the O atoms form a strong network, being able to improve strength of the bonding film 15 and the base film 141 constituting the liquid-repellent film 14. Accordingly, the bonding film 15 exhibits especially high bonding strength with respect to the substrate 20 and the nozzle plate body 10. Further, durability of the liquid-repellent film 14 is especially improved, whereby liquid repellency of the liquid-repellent film 14 can be maintained excellent for long periods of time.

An abundance ratio between the Si atoms and the O atoms in the plasma polymerized film is preferably in a range approximately from 3:7 to 7:3, more preferably in a range approximately from 4:6 to 6:4. By setting the abundance ratio between the Si atoms and the O atoms to be in the above range, stability of the plasma polymerized film can be further improved. Accordingly, the nozzle plate body 10 and the substrate 20 can be more strongly bonded to each other with the bonding film 15 interposed. Further, the coupling agent is securely prevented from separating from the base film 141 composed of the plasma polymerized film, so that the liquid-repellent film 14 exhibits especially excellent liquid repellency.

A crystallinity of the Si skeleton 301 in the plasma polymerized film is preferably equal to or less than 45%, more preferably equal to or less than 40%. Due to the crystallinity in the above range, the Si skeleton 301 obtains a sufficiently random atomic structure. Therefore, the properties of the Si skeleton described above become prominent, enhancing the dimensional accuracy and the adhesiveness of the bonding film 15.

Further, the plasma polymerized film preferably includes Si—H bonds in its structure. The Si—H bonds are produced in a polymeric substance when silane is polymerized to react by the plasma polymerization method. At this time, the Si—H bonds inhibit regular production of siloxane bonds. Therefore, the siloxane bonds are produced in a manner to circumvent the Si—H bonds, degrading regularity of the atomic structure of the Si skeleton 301. Thus, according to the plasma polymerization method, the Si skeleton 301 having low crystallinity can be efficiently produced.

However, crystallinity does not always decrease as the content of the Si—H bonds in the plasma polymerization increases. Concretely, when peak intensity attributed to the siloxane bonds is set to be 1 in infrared absorbing spectrum of the plasma polymerized film, peak intensity attributed to the Si—H bonds is preferably in a range approximately from 0.001 to 0.2, more preferably in a range approximately from 0.002 to 0.05, and furthermore preferably in a range approximately from 0.005 to 0.02. When the ratio of the Si—H bonds with respect to the siloxane bonds is in the above range, the plasma polymerized film having a relatively most random atomic structure is achieved. Therefore, in a case where the peak intensity of the Si—H bonds with respect to the peak intensity of the siloxane bonds is in the above range, the liquid-repellent film 14 and the bonding film 15 obtain especially excellent chemical resistance and the bonding film 15 obtains especially excellent bonding strength and dimensional accuracy.

As described above, when the elimination groups 303 bonded with the Si skeleton 301 are eliminated from the Si skeleton 301, the activation hands 304 are produced on the plasma polymerized film. Therefore, the elimination groups 303 need to be relatively easily and evenly eliminated when energy is applied, and need to be securely bonded with the Si skeleton so as not to be eliminated when no energy is applied.

Based on this perspective, at least one selected from H atoms, B atoms, C atoms, N atoms, O atoms, P atoms, S atoms, and halogen atoms, or an atom group including these atoms that are arranged so as to be bonded with the Si skeleton are preferably used as the elimination groups 303. The elimination groups 303 as above have respectively excellent selectivity of bonding/eliminating by an application of energy. Therefore, excellent adhesiveness can be easily developed on the bonding film 15 by an application of energy. Further, the coupling agent can be more evenly and securely bonded with the surface of the base film 141, especially improving the liquid repellency of the liquid-repellent film 14.

Examples of the atom group (groups) of which the atoms are arranged to be bonded with the Si skeleton 301 includes an alkyl group such as a methyl group and an ethyl group; an alkenyl group such as a vinyl group and an allyl group; an aldehyde group; a ketone group; a carboxyl group; an amino group; an amide group; a nitro group; an alkyl halide group; a mercapto group; a sulfonic acid group; a cyano group; and an isocyanate group.

Among these, the elimination groups 303 are preferably alkyl groups. The alkyl groups have high chemical stability. Therefore, the bonding film 15 can obtain especially excellent weather resistance and chemical resistance. In the base film 141 composed of the plasma polymerized film of which the elimination groups 303 are alkyl groups, due to the alkyl groups left in the base film 141 after an application of energy, the liquid-repellent film 14 obtains improved durability with respect to the ink so as to have long periods of excellent liquid repellency.

Further, in a case where the elimination groups 303 included in the plasma polymerized film are methyl groups ($—CH_3$), a preferable content thereof is defined as follows according to the peak intensity in the infrared absorbing spectrum.

When the peak intensity attributed to the siloxane bonds is set to be 1 in infrared absorbing spectrum of the plasma polymerized film, peak intensity attributed to the methyl groups is preferably in a range approximately from 0.05 to 0.45, more preferably in a range approximately from 0.1 to 0.4, and furthermore preferably in a range approximately from 0.2 to 0.3. When the ratio of the peak intensity of the methyl groups with respect to that of the siloxane bonds is in the above range, the methyl groups are prevented from excessively inhibiting production of the siloxane bonds, and activation hands are produced in necessary and sufficient number in the plasma polymerized film by an application of energy. Therefore, sufficient adhesiveness is developed on the bonding film 15 composed of such the plasma polymerized film, and high reactivity with respect to the coupling agent is generated on the base film 141. Further, sufficient weather resistance and chemical resistance attributed to the methyl groups are developed in the liquid-repellent film 14 and the bonding film 15.

As the constituent material of the plasma polymerized film having such property, a polymeric substance such as polyorganosiloxane including siloxane bonds is used, for example.

Polyorganosiloxane easily eliminates organic groups by an application of energy so as to develop excellent adhesiveness and reactivity with respect to the coupling agent. As a result, the bonding film 15 bonds the nozzle plate body 10 and the substrate 20 more strongly, and the base film 141 and the monomolecular film 142 are strongly bonded to each other in the liquid-repellent film 14 so that the liquid-repellent film 14 exhibits more excellent liquid repellency. Further, the plasma polymerized film made of polyorganosiloxane has excellent mechanical property in itself. This highly improves reliability of the head 1 provided with the nozzle plate 80 having the liquid-repellent film 14 and the bonding film 15 that are made of polyorganosiloxane.

Among polyorganosiloxane, a substance mainly containing a polymeric substance of octamethyltrislioxane is preferably used. Since the plasma polymerized film mainly containing a polymeric substance of octamethyltrisiloxane exhibits especially excellent adhesiveness and reactivity with respect to the coupling agent when energy is applied, the plasma polymerized film is especially favorably used in the nozzle plate of the invention. In addition, a material mainly containing octamethyltrisiloxane is in a liquid state and has a moderate viscosity at room temperature, being able to be easily handled.

An average thickness of the base film 141 constituting the liquid-repellent film 14 is preferably in a range approximately from 20 nm to 1000 nm, more preferably in a range approximately from 2 nm to 800 nm. When the average thickness of the base film 141 is set to be in the above range, liquid repellency of the liquid-repellent film 14 is more securely developed and maintained for long periods of time.

An average thickness of the bonding film 15 is preferably in a range approximately from 1 nm to 1000 nm, more preferably in a range approximately from 2 nm to 800 nm. When the average thickness of the bonding film 15 is in the above range, serious degradation of the dimensional accuracy between the substrate 20 and the nozzle plate 10 can be prevented and the substrate 20 and the nozzle plate 80 can be bonded more strongly.

If the average thickness of the bonding film 15 is below the lower limit of the above range, bonding strength may be disadvantageously insufficient. On the other hand, if the average thickness of the bonding film 15 is larger than the upper limit of the above range, the dimensional accuracy of the head 1 may be seriously degraded.

In addition, when the average thickness of the bonding film 15 is in the above range, shape following property of the bonding film 15 is maintained to some extent. Accordingly, for example, even when an uneven spot exists on the bonding surface (a surface adjacent to the bonding film 15) of the substrate 20, the bonding film 15 can be bonded onto the bonding surface in a manner to follow a shape of the uneven spot, though depending on a height of the uneven spot. As a result, the bonding film 15 engulfs the uneven spot to mitigate the height of the uneven spot formed on the surface of the substrate 20. Therefore, the adhesion property of the bonding film 15 with respect to the substrate 20 can be enhanced in bonding the nozzle plate 80 having the bonding film 15 and the substrate 20.

The shape following property as above becomes more apparent as the thickness of the bonding film 15 is increased. Therefore, in order to maintain a sufficient shape following property, the bonding film 15 needs to be formed as thick as possible.

Second Embodiment

The head 1 can be manufactured as the following description, for example. Hereinafter, a manufacturing method of the head 1 (a method for manufacturing a droplet discharge head according to the invention) will be described.

FIGS. 6A to 10C are diagrams (longitudinal sectional views) for explaining a method for manufacturing an ink-jet type recording head. In the following description, the upper side in FIGS. 6A to 10C is described as "upper", while the lower side is described as "lower".

A method for manufacturing a head 1 of the embodiment includes: preparing the nozzle plate 80 and a bonded body 90; developing adhesiveness on a surface of the bonding film 15; and bonding the nozzle plate 80 to the substrate 20 of the bonded body 90 in a manner to interpose the bonding film 15 on which the adhesiveness is developed. The nozzle plate 80 is formed such that the liquid-repellent film 14 and the bonding film 15 are respectively formed on both surfaces of the nozzle plate body 10 having the nozzles 11. The bonded body 90 is formed by bonding the substrate 20, the sealing sheet 30, the vibrating plate 40, the piezoelectric element 50, and the case head 60. The adhesiveness is developed on the surface of the bonding film 15 such that energy is applied to the surface of the bonding film 15 formed on one surface of the nozzle plate 80 so as to eliminate the elimination groups 303 existing around the surface of the bonding film 15 from the Si skeleton 301.

Each step will be sequentially described below.

[1] The nozzle plate 80 described above and the bonded body 90 which is obtained by bonding the substrate 20, the sealing sheet 30, the vibrating plate 40, the piezoelectric element 50, and the case head 60 will be prepared.

Figure 6A:
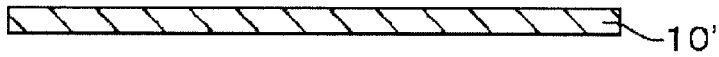
FIGS. 6A to 6E are diagrams (longitudinal sectional views) for explaining a method for manufacturing an ink-jet type recording head.

[1A] A base member 10' for forming the nozzle plate body 10 is first prepared (refer to FIG. 6A). The base member 10' is to be the nozzle plate body 10 by forming the nozzles 11 in a step described later.

Figure 6B:
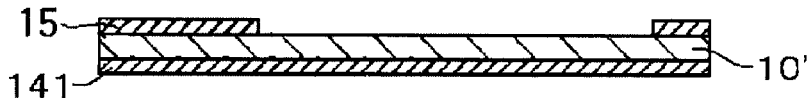

On both surfaces of the base member 10', the base film 141 of the liquid-repellent film 14 and the bonding film 15 are respectively formed by the plasma polymerization method (refer to FIG. 6B). The plasma polymerization method is such a method that a mixture gas of a material gas and a carrier is supplied to an intense electric field, for example, so as to polymerize a molecule in the material gas and deposit the polymerized substance on the base member 10', thus forming a film.

A method for forming the base film 141 and the bonding film 15 by the plasma polymerization method will be described in detail below. However, before the description of the method for forming the base film 141 and the bonding film 15, a plasma polymerization device used for forming the film 141 and the film 15 on the base material 10' by the plasma polymerization method will be described.

Figure 11:
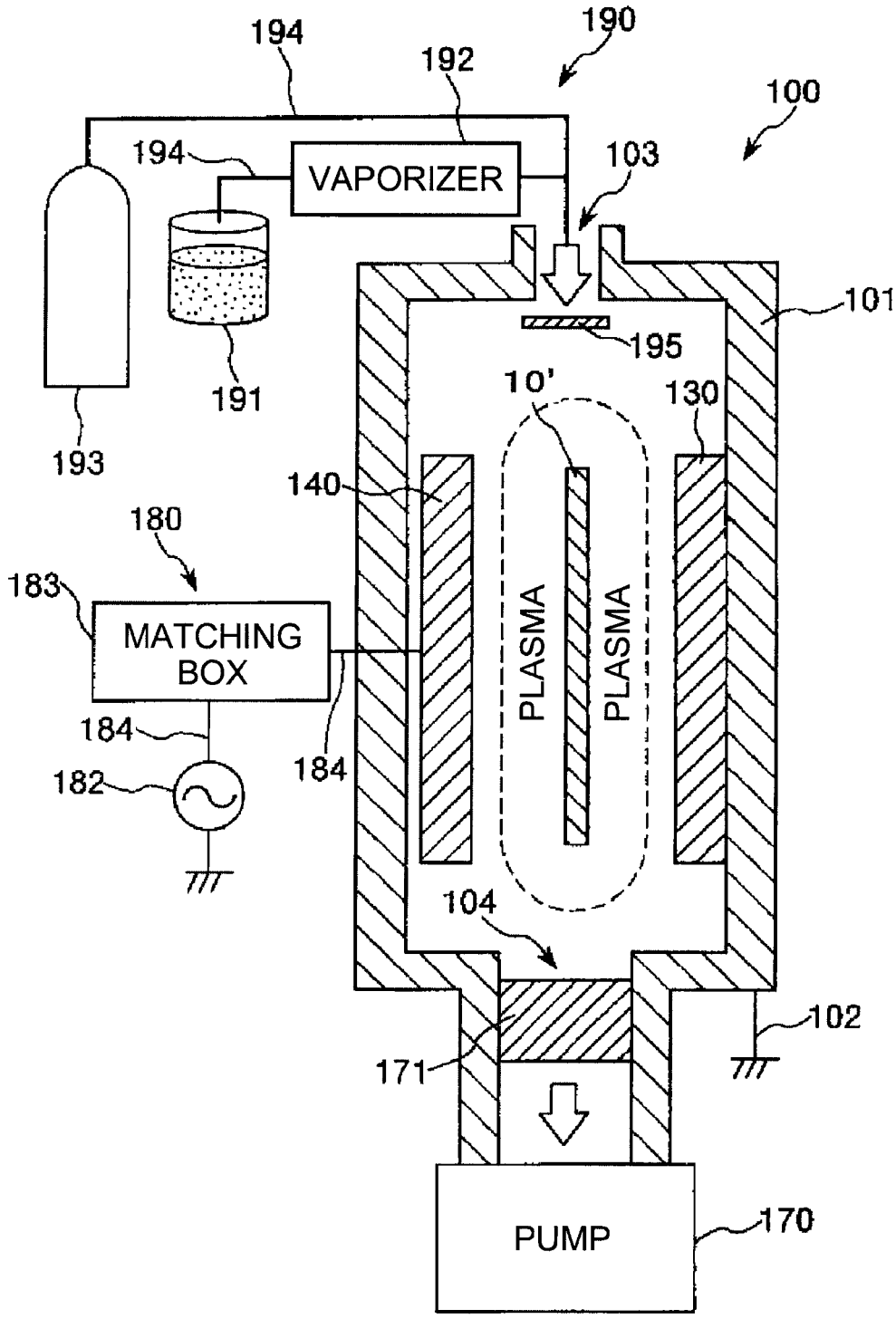
FIG. 11 is a longitudinal sectional view schematically showing a plasma polymerization device used for forming a plasma polymerized film which is included in the ink-jet type recording head.

FIG. 11 is a longitudinal sectional view schematically showing a plasma polymerization device used for forming a plasma polymerized film which is included in the ink-jet type recording head of the embodiment. In the following description, the upper side in FIG. 11 is described as "upper", while the lower side is described as "lower".

This plasma polymerization device 100 shown in FIG. 11 includes: a chamber 101, a first electrode 130, a second electrode 140, a power supply circuit 180 applying a high frequency voltage between the electrodes 130 and 140, a gas supply section 190 supplying a gas into the chamber 101, and an exhaust pump 170 exhausting the gas from the chamber 101. Among these components, the first and the second electrodes 130 and 140 are provided in the chamber 101. Hereinafter, details of each of the components will be described.

The chamber 101 is a container that maintains air tightness of the inside thereof, and has pressure resistance by which the chamber 1 is capable of enduring against a pressure difference between the inside and the outside thereof for being used in a condition where a pressure inside of the chamber 101 is reduced (in a vacuum condition).

The chamber 101 shown in FIG. 11 is composed of a chamber main body having an approximately cylindrical shape whose axial line is arranged in a horizontal direction, a circular side wall sealing a left opening portion of the chamber main body, and a circular side wall sealing a right opening portion of the same.

At an upper portion of the chamber 101 is provided a supply outlet 103 and at a lower portion of the same is provided an exhaust outlet 104. The gas supply section 190 is coupled to the supply outlet 103, while the exhaust pump 170 is coupled to the exhaust outlet 104.

In the present embodiment, the chamber 101 is made of a highly conductive metal material and electrically grounded via a ground line 102.

The first electrode 130 is vertically provided on an inner wall surface of a side wall of the chamber 101 so as to be electrically grounded via the chamber 101. As shown in FIG. 11, the first electrode 130 is arranged concentrically with respect to the chamber main body.

Between the first electrode 130 and the second electrode 140, a holder (not shown) for supporting and fixing the base member 10' between a pair of electrodes 130 and 140 is provided. Thus, the base material 10' is fixed between the pair of electrodes 130 and 140 in the chamber 101 by the holder. Therefore, plasma polymerized films can be simultaneously formed on the both surfaces of the base member 10' by operating the power supply circuit 180 described later.

The second electrode 140 is provided to be opposed to the first electrode 130 with the base material 10' interposed. The second electrode 140 is formed in a manner to be separated (insulated) from the inner wall surface of the side wall of the chamber 101.

To the second electrode 140, a high frequency power supply 182 is coupled via a wiring 184. At a predetermined point of the wiring 184, a matching box 183 is provided. The wiring 184, the high frequency power supply 182, and the matching box 183 constitute the power supply circuit 180.

According to the power supply circuit 180, since the first electrode 130 is grounded, high frequency voltage is applied between the first and the second electrodes 130 and 140. Thereby, an electric field is induced in a space between the first electrode 130 and the second electrode 140. A direction of the electric field is reversed at high frequency.

The gas supply section 190 supplies a predetermined gas into the chamber 101.

The gas supply section 190 shown in FIG. 11 includes a reservoir section 191 storing a liquid film material (a raw material liquid), a vaporizer 192 evaporating the liquid film material to change the material into a gas, and a gas cylinder 193 storing carrier gas. These sections are coupled to the supply outlet 103 of the chamber 101 via a pipe 194 so as to supply a mixture gas of a gaseous film material (a raw gas) and the carrier gas into the chamber 101 from the supply outlet 103.

The liquid film material stored in the reservoir section 191 is a raw material which is polymerized by the plasma polymerization device 100 so as to form polymerized films on surfaces of the first base member 10'.

The liquid film material as above is evaporated by the vaporizer 192 into a gaseous film material (the raw gas) to be supplied to the chamber 101. The raw gas will be described in detail later.

The carrier gas stored in the gas cylinder 193 discharges electricity due to an influence of an electric field and therefore is introduced to maintain the electric discharge. As the carrier gas, Ar gas or He gas, for example, can be used.

In the chamber 101, a diffusion plate 195 is provided near the supply outlet 103.

The diffusion plate 195 serves to promote diffusion of the mixture gas supplied in the chamber 101. Due to the diffusion plate 195, the mixture gas can be diffused with a nearly even concentration in the chamber 101.

The exhaust pump 170 performs exhaust of the inside of the chamber 101. For example, the exhaust pump 170 is an oil-sealed rotary pump, a turbo-molecular pump, or the like. Thus, the chamber 101 is exhausted so as to reduce pressure inside, whereby the gas can be easily converted into plasma. In addition, the exhaust pump 170 can prevent contamination, oxidization, or the like of the base member 10' caused by contact with the air atmosphere, and can effectively remove a reaction product, which is produced by plasma treatment, out of the chamber 101.

Furthermore, at the exhaust outlet 104, a pressure control mechanism 171 adjusting the pressure inside the chamber 101 is provided. Due to the mechanism 171, the pressure inside the chamber 101 can be appropriately set according to operating states of the gas supply section 190.

Next, a method for forming plasma polymerized films (the base film 141 of the liquid-repellent film 14 and the bonding film 15) on the both surfaces of the base member 10' will be described.

First, after the base member 10' is put in the holder for fixing the base member 10' between the pair of electrodes 130 and 140 in the chamber 101 of the plasma polymerization device 100 so as to be sealed, pressure in the chamber 101 is decreased by an operation of the exhaust pump 170.

Then, the gas supply section 190 is operated so as to supply the mixture gas of the raw gas and the carrier gas into the chamber 101. The mixture gas that is supplied is filled in the chamber 101.

Here, though a ratio of the raw gas in the mixture gas (a mixture ratio) varies slightly depending on kinds of the raw gas and the carrier gas, an intended film-formation rate, and the like, the ratio of the raw gas in the mixture gas is preferably in a range approximately from 20% to 70%, more preferably in a range approximately from 30% to 60%, for example. Thereby, conditions for formation of the polymerized films (film-formation) can be optimized.

A flow rate of the gas to be supplied is arbitrarily determined depending on a kind of the gas, an intended film-forming rate, a film thickness, and the like. Thus, the flow rate is not especially limited, but the flow rate of each of the row gas and the carrier gas is commonly set to be preferably in a range approximately from 1 ccm to 100 ccm, more preferably in a range approximately from 10 ccm to 60 ccm.

Then, the power supply circuit 180 is operated to apply high frequency voltage between the pair of electrodes 130 and 140. Thereby, gas molecules existing between the electrodes 130 and 140 are ionized, generating plasma. Molecules in the raw gas are polymerized by energy of the plasma, and the polymeric substance attaches and deposits on the both surfaces of the base member 10' that is put in the holder. Thus the plasma polymerized films are formed on the both surfaces of the base member 10' as shown in FIG. 6B. The plasma polymerized film formed on one surface of the base member 10' becomes the base film 141, on which reactivity with respect to the coupling agent is developed, by an application of energy, and the plasma polymerized film formed on the other surface of the base member 10' becomes the bonding film 15, on which adhesiveness is developed, by an application of energy.

By employing the forming method of plasma polymerized films as above, the base film 141 of the liquid-repellent film 14 and the bonding film 15 can be simultaneously formed on the base material 10'. Thereby, the head 1 that has high dimensional accuracy can be efficiently manufactured through fewer steps than a common case employing related art manufacturing method in which after a liquid-repellent treatment is conducted on one surface of a nozzle plate, the other surface of the nozzle plate and a substrate having a cavity are bonded with an adhesive made of epoxy resin, for example.

Further, the surfaces of the base member 10' are activated and cleaned due to an influence of the plasma. Accordingly, the polymeric substance of the raw gas easily deposits on the surfaces of the base member 10', enabling stable film forming of the plasma polymerized films (the base film 141 and the bonding film 15). Thus, the plasma polymerization method enhances adhesion strength of the base member 10' with respect to the base film 141 and the bonding film 15 irrespective of the constituent material of the base member 10'.

The raw gas may be a gas of organosiloxane such as methylsiloxane, octamethyltrisiloxane, decamethyltetrasiloxane, decamethylcyclopentasiloxane, octamethylcyclotetrasiloxane, and methylphenylsiloxane, for example.

The plasma polymerized films obtained by using the raw gas as above, that is, the base film 141 and the bonding film 15 are composed of a polymeric substance of the above materials, that is, made of polyorganosiloxane.

A frequency of the high frequency power applied between the electrodes 130 and 140 is not specifically limited in plasma polymerization, but is preferably in a range approximately from 1 kHz to 100 MHz, more preferably in a range approximately from 10 MHz to 60 MHz.

An output density of the high frequency power is not specifically limited, but is preferably in a range approximately from 0.01 $W/cm^2$ to 100 $W/cm^2$, more preferably in a range approximately from 0.1 $W/cm^2$ to 50 $W/cm^2$, furthermore preferably in a range approximately from 1 $W/cm^2$ to 40 $W/cm^2$. When the output density of the high frequency power is set to be in the above range, an excessive application of the plasma energy, which is caused by excessively high output density of the high frequency power, to the raw gas is prevented, and the Si skeleton 301 having a random atomic structure can be securely formed. In a case where the output density of the high frequency power is lower than the lower limit of the above range, polymerization reaction can not be induced in molecules in the raw gas. As a result, the bonding film 15 may not be able to be formed. On the other hand, in a case where the output density of the high frequency power is higher than the upper limit of the above range, the raw gas may be degraded, for example, and therefore structures to be the elimination groups 303 may be eliminated from the Si skeleton 301. Accordingly, the bonding film 15 to be obtained may have substantially low content of the elimination groups 303 or the random property of the Si skeleton 301 may be degraded (regularity may be increased).

Further, pressure in the chamber 101 in film forming is preferably in a range approximately from 133.3 $Pa\times10^{-5}$ to 1333 Pa (1 $Torr\times10^{-5}$ to 10 Torr), more preferably in a range approximately from 133.3 $Pa\times10^{-4}$ to 133.3 Pa (1 $Torr\times10^{-4}$ to 1 Torr).

The flow rate of the raw gas is preferably in a range approximately from 0.5 sccm to 200 sccm, more preferably in a range approximately from 1 sccm to 100 sccm. The flow rate of the carrier gas is preferably in a range approximately from 5 sccm to 750 sccm, more preferably in a range approximately from 10 sccm to 500 sccm.

Treatment time is preferably in a range approximately from 1 minute to 10 minutes, more preferably in a range approximately from 4 minutes to 7 minutes. The thickness of the plasma polymerized films (the base film 141 and the bonding film 15) to be formed is mainly proportional to the treatment time. Therefore, the thickness of the plasma polymerized films can be easily adjusted only by adjusting the treatment time. Thus, the thickness of the bonding film 15 can be precisely controlled, so that a distance between the nozzle plate body 10 and the substrate 20 can be precisely controlled unlike related art in which an adhesive is used to bond a substrate and a nozzle plate and therefore a thickness of the adhesive can not be precisely controlled.

A temperature of the nozzle plate body 10 is preferably equal to or higher than 25° C., more preferably in a range approximately from 25° C. to 100° C.

As above, the nozzle plate 80 in which the base film 141 and the bonding film 15 are respectively formed on both surfaces of the nozzle plate body 10 can be obtained.

In a case where the bonding film 15 is formed only on a part, which is to be bonded to the substrate 20, of the base member 10', a mask having a window portion in a shape corresponding to the part can be formed on the surface, on which the film 15 is to be formed, of the base member 10' so as to form the film 15 over the mask.

In the present embodiment, the plasma polymerized films are simultaneously formed on the both surfaces of the base member 10'. However, after a plasma polymerized film is formed on one surface of the base member 10', another plasma polymerized film may be formed on the other surface.

In addition, it is preferably that a surface treatment for enhancing adhesion property with respect to the plasma polymerized films (the base film 141 and the bonding film 15) be performed on regions, on which the plasma polymerized films are to be formed, of the base member 10'. Due to the treatment, the bonding strength between the nozzle plate body 10 and the plasma polymerized films can be further improved. As a result, the liquid-repellent film 14 obtains excellent durability and the bonding strength between the nozzle plate body 10 and the substrate 20 between which the bonding film 15 is interposed is highly enhanced.

For example, the surface treatment may be a physical surface treatment such as sputtering treatment and blast treatment; a plasma treatment using oxygen plasma, nitrogen plasma, or the like; a chemical surface treatment such as corona discharge treatment, etching treatment, electron beam radiation treatment, UV radiation treatment, and ozone exposure treatment; or a combination of these treatments. By performing such treatment on the regions, on which the plasma polymerized films are to be formed, of the base member 10', the regions can be cleaned and activated.

Among the above surface treatments, the plasma treatment can especially optimize the surfaces of the base member 10' for forming the plasma polymerized films.

Here, in a case where the base member 10' subjected to the surface treatment is made of a resin material (a polymeric material), especially the corona discharge treatment, the nitrogen plasma treatment, or the like are preferably used.

Depending on the material of the base member 10', the base member 10' has sufficient bonding strength with respect to the plasma polymerized films, even if the above surface treatment is not performed. The constituent material, providing such advantageous effect, of the base member 10' may mainly include various metal materials, various silicon materials, and various glass materials described above, for example.

In the base member 10' made of such materials, the surfaces thereof are covered with oxide films on which relatively highly active hydroxyl groups are bonded. Therefore, the base member 10' made of such materials can be strongly bonded with the plasma polymerized films even without the above surface treatment.

In this case, the whole of the base member 10' is not necessarily made of the above materials, but at least around surfaces of the regions, on which the plasma polymerized films are to be formed, may be made of the above materials.

Further, in a case where the regions, on which the plasma polymerized films are to be formed, of the base member 10' include the following groups or substances, the bonding strength between the base member 10' and the plasma polymerized films can be sufficiently improved without the above surface treatment.

Examples of the groups and substances include: a functional group such as a hydroxyl group, a thiol group, a carboxyl group, an amino group, a nitro group, and an imidazole group; unsaturated bonds such as radicals, ring-opened molecules, double bonds, and triple bonds; halogen such as F, Cl, Br, and I; and peroxide. Among these, at least one group or substance may be selected.

In order to obtain a surface having such groups or substances, it is preferable that a surface treatment be arbitrarily selected from the above surface treatments and conducted.

Alternatively, instead of the surface treatment, it is preferable that intermediate layers are formed in advance on the regions, on which the plasma polymerized films are to be formed, of the base member 10'.

The intermediate layers may have any function, and for example, preferably, have a function of increasing the adhesion property with respect to the plasma polymerized films, a cushioning function (a buffer function), and a function of reducing stress concentration. By forming the plasma polymerized films on the base member 10' with such intermediate layers interposed, the bonding strength between the base member 10' and the plasma polymerized films (the base film 141 and the bonding film 15) is improved, being able to provide the nozzle plate 80 having high reliability, further, the head 1 having high reliability.

Examples of a material of the intermediate layers include: a metal material such as aluminum and titanium; oxide materials such as metal oxide and silicon oxide; nitride materials such as metal nitride and silicon nitride; carbon materials such as graphite and diamond-like carbon; and self-assembled film materials such as a silane coupling agent, a thiol compound, metal alkoxide, and a metal-halogen compound. These may be used singly or in a combined manner of two or more.

Among these materials, particularly, using the oxide material for the intermediate layers can especially increase the bonding strength between the base member 10' and the plasma polymerized films.

Figure 6C:
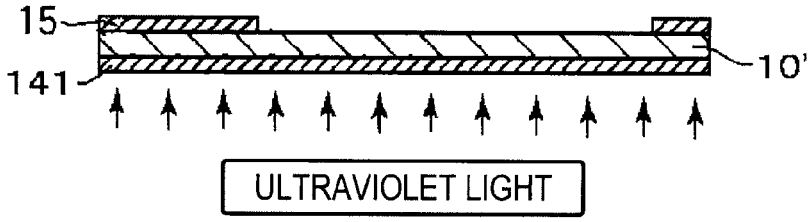

[1B] Energy is applied to the base film 141 of the base member 10' (refer to FIG. 6C).

By an application of energy, the elimination groups 303 are eliminated from the Si skeleton 301 in the base film 141, as shown in FIG. 4. After the elimination groups 303 are eliminated, the activation hands 304 are produced on the surface and the inside of the base film 141. Thereby, reactivity with respect to the coupling agent (the reactive functional group of the coupling agent) is developed on the surface of the base film 141.

Here, energy may be applied to the base film 141 in any method of the following typical methods: (I) energy beam irradiation and (II) heat application. As other methods, exposure to plasma (plasma energy provision), exposure to ozone gas (chemical energy provision), and the like may be employed.

Among these, at least one method from methods (I) and (II) is preferably employed as the method for applying energy to the base film 141. These methods are favorable as the energy applying method because energy can be efficiently applied to the base film 141 with relative ease.

The methods (I) and (II) will now be described in detail.

(I) In a case where the base film 141 is irradiated with an energy beam, the energy beam may be light such as ultraviolet light and laser light; a particle beam such as X ray, gamma ray, electron ray, and an ion beam; or a combination of these energy beams, for example. By employing the energy beam irradiation method as the method for applying energy to the base film 141, energy can be selectively applied only to the base film 141 of the nozzle plate 80.

Among the above energy beams, especially, ultraviolet light having a wavelength of about 150 nm to about 300 nm is preferably adopted (refer to FIG. 6C). According to the ultraviolet light, an amount of energy to be applied is optimized, so that the Si skeleton 301 in the base film 141 is prevented from being excessively destroyed, and bonds between the Si skeleton 301 and the elimination groups 303 can be selectively cleaved. Thereby, degradation of properties (a mechanical property and a chemical property) of the base film 141 is prevented, improving durability of the liquid-repellent film 14.

With the ultraviolet light, energy can be evenly applied on a wide area in a short period of time, so that the elimination groups 303 can be efficiently eliminated. Furthermore, ultraviolet light can be advantageously produced with simple equipment such as an UV lamp.

Here, ultraviolet light more preferably has a wavelength in a range approximately from 160 nm to 200 nm.

In a case of using the UV lamp, though it depends on an area of the base film 141, an output is preferably in a range approximately from 1 $mW/cm^2$ to 1 $W/cm^2$, more preferably in a range approximately from 5 $mW/cm^2$ to 50 $mW/cm^2$. In this case, a distance between the UV lamp and the base film 141 is preferably set to be in a range approximately from 3 mm to 3000 mm, more preferably in a range approximately from 10 mm to 1000 mm.

Irradiation time of the ultraviolet light is preferably set to be in an extent that the elimination groups 303 around the surface of the base film 141 can be eliminated, that is, an extent that a large quantity of the elimination groups 303 inside the base film 141 are not permitted to be eliminated. Specifically, though it depends on a light amount of ultraviolet light, a constituent material of the base film 141, and the like, the irradiation time is preferably in a range approximately from 0.5 minutes to 30 minutes, more preferably in a range approximately from 1 minute to 10 minutes.

Ultraviolet light may be applied temporally continuously or intermittently (in a pulsed manner).

On the other hand, examples of the laser light include excimer laser (femtosecond laser), Nd-YAG laser, Ar laser, $CO_2$ laser, and He—Ne laser.

The base film 141 may be irradiated with an energy beam in any atmosphere. Examples of the atmosphere include: an oxidized gas atmosphere such as an air atmosphere and an oxygen atmosphere; a reducing gas atmosphere such as a hydrogen atmosphere; an inert gas atmosphere such as a nitrogen atmosphere and an argon atmosphere; or a reduced pressure (vacuumed) atmosphere obtained by reducing pressure of the above atmospheres. Among these, the film 141 is preferably irradiated with an energy beam especially in the air atmosphere. Accordingly, the energy beam irradiation can be more easily performed without any trouble and cost for controlling the atmosphere.

According to the energy beam irradiation method, energy can be selectively applied to the base film 141 with ease, so that alteration and deterioration, which are caused by the energy application, for example, of the nozzle plate body 10 and the bonding film 15 can be prevented.

Further, according to the energy beam irradiation method, energy can be efficiently applied to the surface and the inside of the base film 141, being able to eliminating the elimination groups 303 in a sufficient amount. Accordingly, the coupling agent can be more securely bonded with the surface of the base film 141, especially improving the liquid repellency of the liquid-repellent film 14.

According to the energy beam irradiation method, a large amount of energy can be applied in a short period of time. Thus, the energy can be efficiently applied.

(II) In a case where the base film 141 is heated (not shown), a heating temperature is preferably set to be in a range approximately from 25° C. to 100° C., more preferably in a range approximately from 50° C. to 100° C. When the base film 141 is heated at the temperature in the above range, alteration and deterioration, which is caused by heat, of the nozzle plate body 10 can be securely prevented and the base film 141 can be securely activated.

Further, heating time is set to be in an extent that molecular bonds in the base film 141 can be cleaved. Specifically, the heating time is preferably in a range approximately from 1 minute to 30 minutes when the heating temperature is set to be in the above-mentioned range.

The base film 141 may be heated by any method among various heating methods such as using a heater, infrared ray irradiation, and flame contact.

By the methods (I) and (II) described above, energy can be applied to the base film 141.

As described above, the base film 141 in a state before energy is applied thereto has the Si skeleton 301 and the elimination groups 303 as shown in FIG. 4. When energy is applied to the base film 141 in such state, the elimination groups 303 (methyl groups in the embodiment) are eliminated from the Si skeleton 301. Thereby, the activation hands 304 are produced on a surface 145 of the base film 141, activating the surface 145. As a result, reactivity with respect to the coupling agent (the reactive functional group of the coupling agent) is developed on the surface of the base film 141.

Here, "activating" the base film 141 means a state in which the elimination groups 303 of the surface 145 and the inside of the base film 141 are eliminated and thus non-terminated bonds (hereinafter, also referred to as "non-bonding hands" or "dangling bonds") are produced in the Si skeleton 301; a state in which the non-bonding hands are terminated by hydroxyl groups (OH groups); or a state of coexistence of these states.

Therefore, the activation hands 304 are non-bonding hands (dangling bonds) or bonds obtained by terminating the non-bonding hands by hydroxyl groups. Such the activation hands 304 react with the reactive functional groups of the coupling agent and thus the coupling agent is bonded with the surface of the base film 141 so as to form the monomolecular film 142.

Here, the latter state (the state in which the non-bonding hands are terminated by hydroxyl groups) can be easily produced by irradiating the base film 141 with an energy beam under an air atmosphere and thus terminating the non-bonding hands by moisture in the air.

Figure 6D:
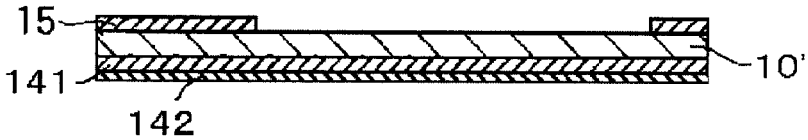

[1C] The coupling agent is applied to the surface of the base film 141 on which energy has been applied, so as to form the monomolecular film 142 made of the coupling agent on the base film 141 (refer to FIG. 6D).

The coupling agent may be applied (bonded) to the surface of the base film 141 in the following method: an immersion method by which the base film 141 is immersed in a solution containing the coupling agent; an application method by which a solution containing the coupling agent is applied to a surface of the base film 141; and a spraying method by which a solution containing the coupling agent is sprayed (showered) to the surface of the base film 141, for example. Among these, the immersion method is preferably employed.

According to the immersion method, the coupling agent can be securely bonded with the surface of the base film 141 and the monomolecular film 142 formed on the base film 141 has an even thickness. Further, in the embodiment, energy is applied only to the base film 141 in the previous step [1B], so that reactivity described above is not developed on the bonding film 15. Therefore, even in a case where the whole of the base member 10' and the plasma polymerized films formed on the both surfaces of the base member 10' are immersed in a solution of the coupling agent by the immersion method, the coupling agent is not bonded to the surface of the bonding film 15. Accordingly, a step of bonding the coupling agent with the surface of the base film 141 is further simplified, improving the manufacturing efficiency of the head 1.

A case where the monomolecular film 142 is formed by the immersion method will be described below.

A process solution is first prepared by dissolving a coupling agent as mentioned above in an organic solvent.

Various solvents may be used as the solvent for dissolving the coupling agent. The solvent may be an aromatic hydrocarbon solvent such as toluene, xylene, trimethylbenzene, tetramethylbenzene, and cyclohexylbenzene.

The concentration of the coupling agent in the process solution is preferably in a range approximately from 0.01 wt % to 0.5 wt %, more preferably in a range approximately from 0.1 wt % to 0.3 wt %.

After the base member 10' on which the base film 141 is formed is immersed in the process solution for a predetermined period of time, the base member 10' is pulled out.

When the base member 10' is immersed in the process solution of the coupling agent, the reactive functional groups of the coupling agent react with the activation hands 304 of the base film 141, whereby the coupling agent is bonded with the base film 141. Thus, the monomolecular film 142 is formed on the base film 141.

The temperature of the process solution for immersing the base member 10' therein is preferably in a range approximately from 10° C. to 200° C., more preferably in a range approximately from 20° C. to 100° C.

The immersing time of the base member 10' is preferably in a range approximately from 0.1 seconds to 180 seconds, more preferably in a range approximately from 10 seconds to 60 seconds.

The pulling-out velocity of the base member 10' is preferably in a range approximately from 0.5 mm/sec to 50 mm/sec, more preferably in a range approximately from 10 mm/sec to 30 mm/sec.

When conditions for immersing the base member 10', on which the base film 141 is formed, in the process solution are in the above ranges, the coupling agent can be securely bonded with the base film 141.

Figure 6E:
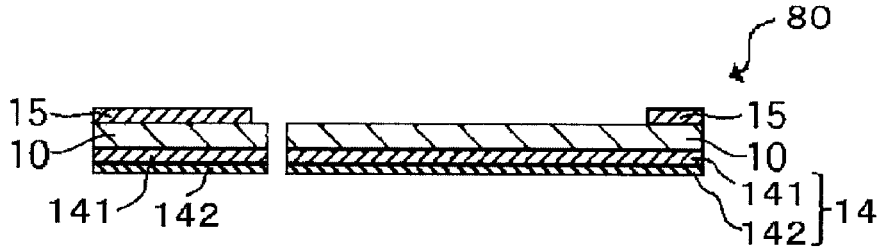

[1D] Next, the nozzle 11 penetrating the base member 10', the plasma polymerized films which are formed, and the monomolecular film 142 made of the coupling agent is formed (refer to FIG. 6E).

A forming method for the nozzle 11 is not specifically limited. However, the nozzle 11 may be formed by one or more than one in combination of the following exemplary methods; physical etching such as dry etching, reactive ion etching, beam etching, and photo assist etching; and chemical etching such as wet etching, for example. By the method, the nozzle 11 penetrating a predetermined position of the base member 10' on which the bonding film 15 and the base film 141 provided with the monomolecular film 142 are formed can be formed.

Accordingly, the nozzle plate 80 having the nozzle 11 and structured such that the liquid-repellent film 14 and the bonding film 15 are respectively formed on the both surfaces of the nozzle plate body 10 can be obtained. By adopting such the nozzle plate 80, the manufacturing process of the head 1 can be simplified and the head 1 having high dimensional accuracy can be efficiently manufactured.

Further, the nozzle plate 80 is formed such that after the plasma polymerized films are formed on the base member 10' which is to be the nozzle plate body 10, the nozzle 11 is formed. In such the nozzle plate 80, the plasma polymerized films having liquid repellency with respect to the ink are prevented from attaching the inner circumference portion of the nozzle 11, so that the discharge amount of the ink from the nozzle 11 can be precisely controlled. In contrast, in a case where plasma polymerized films are formed on a nozzle plate having a nozzle, the plasma polymerized films attach the inner circumference portion of the nozzle 11, causing a possibility that the discharge amount of the ink discharged from the nozzle can not be precisely controlled.

[1E] Subsequently, a base member 20' for forming the substrate 20 is prepared. The base member 20' is processed in a later described step so as to be the substrate 20.

Figure 7A:
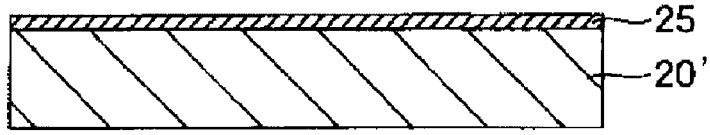
FIGS. 7A to 7F are diagrams (longitudinal sectional views) for explaining the method for manufacturing an ink-jet type recording head.

Then, the bonding film 25 is formed on the base member 20' as shown in FIG. 7A. The bonding film 25 may be made of the materials mentioned above.

Figure 7B:
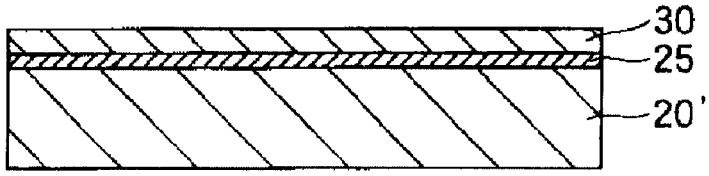

[1F] The sealing sheet 30 is prepared. Then, the base member 20' and the sealing sheet 30 are laminated together in a manner to tightly contact the bonding film 25 and the sealing sheet 30. Thus, the base member 20' and the sealing sheet 30 are bonded (adhesively bonded) to each other with the bonding film 25 interposed, as shown in FIG. 7B.

Figure 7C:
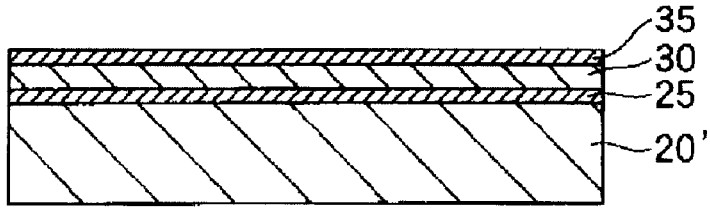

[1G] Next, the bonding film 35 is formed on the sealing sheet 30, as shown in FIG. 7C. The bonding film 35 may be made of the materials mentioned above.

Figure 7D:
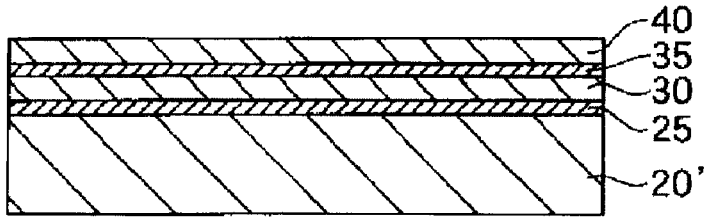

[1H] The vibrating plate 40 is prepared. Then, the base member 20' provided with the sealing sheet 30 and the vibrating plate 40 are laminated together in a manner to tightly contact the bonding film 35 and the vibrating plate 40. Thus, the sealing sheet 30 and the vibrating plate 40 are bonded (adhesively bonded) to each other with the bonding film 35 interposed. Accordingly, the base member 20', the sealing sheet 30, and the vibrating plate 40 are bonded to each other, as shown in FIG. 7D.

Figure 7E:
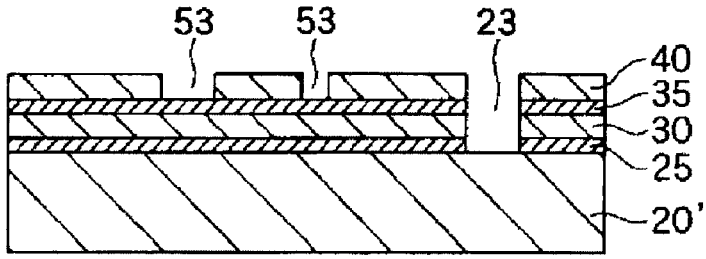

[1I] As shown in FIG. 7E, a through hole 23 is formed on a position, which corresponds to the liquid supply chamber 22 of the head 1, of the bonding film 25, the sealing sheet 30, the bonding film 35, and the vibrating plate 40.

Further, in the vibrating plate 40, a recessed portion 53 is formed in a circular region surrounding a position on which the piezoelectric element 50 is to be formed.

The through hole 23 and the recessed portion 53 may be formed by preferably using the above-mentioned etching method which can be used as the forming method of the nozzle 11.

Figure 7F:
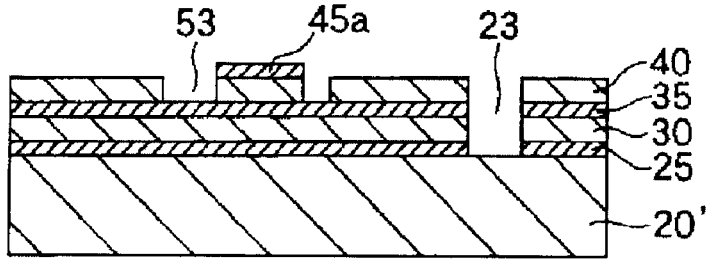

[1J] As shown in FIG. 7F, the bonding film 45*a* is formed on a position, on which the piezoelectric element 50 is to be formed, of the vibrating plate 40. The bonding film 45*a* may be made of the materials mentioned above.

Figure 8A:
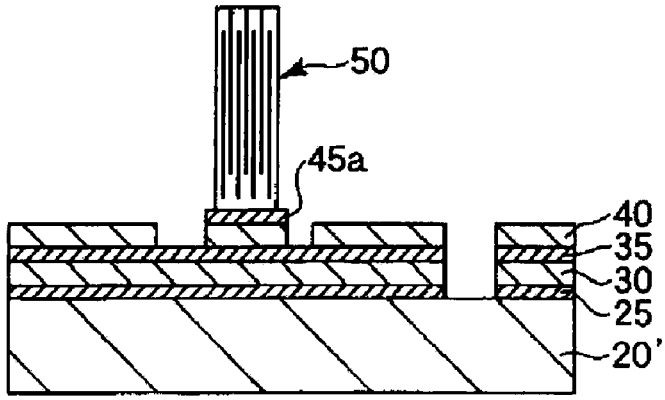
FIGS. 8A to 8C are diagrams (longitudinal sectional views) for explaining the method for manufacturing an ink-jet type recording head.

[1K] The piezoelectric element 50 is prepared. Then, the vibrating plate 40 and the piezoelectric element 50 are brought together in a manner to tightly contact the bonding film 45*a* and the piezoelectric element 50. Thus, the vibrating plate 40 and the piezoelectric element 50 are bonded (adhesively bonded) to each other with the bonding film 45*a* interposed. Accordingly, the base member 20', the sealing sheet 30, the vibrating plate 40, and the piezoelectric element 50 are bonded to each other, as shown in FIG. 8A.

Figure 8B:
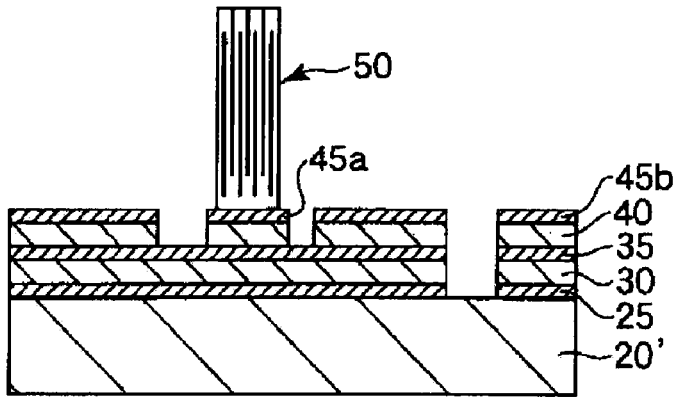

[1L] As shown in FIG. 8B, the bonding film 45*b* is formed on a position, on which the case head 60 is to be formed, of the vibrating plate 40. The bonding film 45*b* may be made of the materials mentioned above.

Figure 8C:
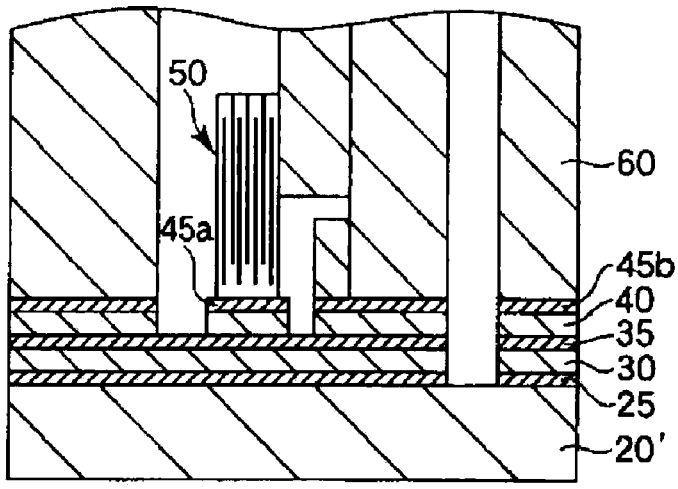
Figure 9A:
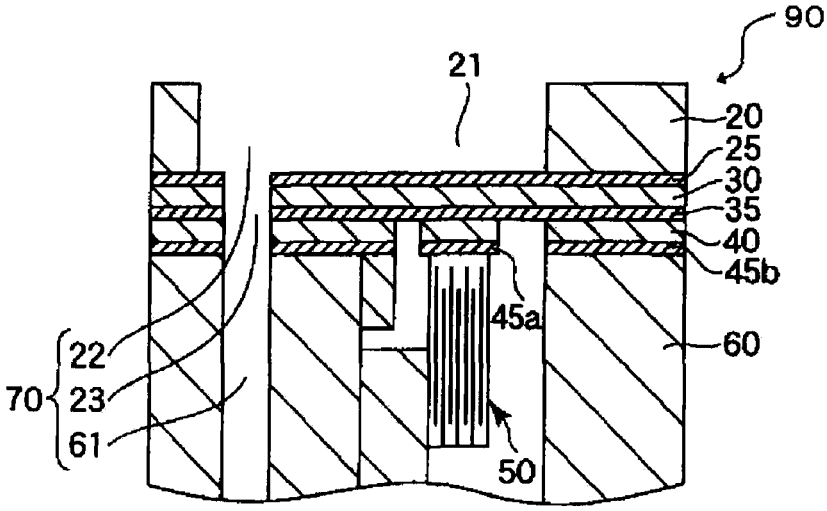
FIG. 9A is a diagram (longitudinal sectional view) for explaining the method for manufacturing an ink-jet type recording head.

[1M] The case head 60 is prepared. Then, the vibrating plate 40 and the case head 60 are brought together in a manner to tightly contact the bonding film 45*b* and the case head 60. Thus, the vibrating plate 40 and the case head 60 are bonded (adhesively bonded) to each other with the bonding film 45*b* interposed. As a result, the base member 20', the sealing sheet 30, the vibrating plate 40, and the piezoelectric element 50 and the case head 60 are bonded to each other, as shown in FIG. 8C.

[1N] The base member 20' on which the sealing sheet 30, the vibrating plate 40, the piezoelectric element 50 and the case head 60 are bonded is inverted upside down. Then, a surface, which is opposite to a surface on which the sealing sheet 30 is bonded, of the base member 20' is processed so as to form the liquid storage chambers 21 and the liquid supply chamber 22. Accordingly, the substrate 20 is obtained from the base member 20'. Thus, the bonded body 90 in which the substrate 20, the sealing sheet 30, the vibrating plate 40, the piezoelectric element 50, and the case head 60 are bonded is obtained (refer to FIG. 9A). The liquid supply chamber 22 is communicated with the through hole 23 formed in the bonding film 25, the sealing sheet 30, the bonding film 35, and the vibrating plate 40, and the liquid supply path 61 formed in the case head 60, forming the reservoir 70.

The base member 20' may be processed by the etching method described above, for example.

In the embodiment, the liquid storage chambers 21 and the liquid supply chamber 22 are formed by processing the base member 20' on which the sealing sheet 30, the vibrating plate 40, the piezoelectric element 50, and the case head 60 are bonded. However, the liquid storage chambers 21 and the liquid supply chamber 22 may be formed in advance in the step [1E].

[2] Next, the nozzle plate 80 will be bonded to the substrate 20 of the bonded body 90 with the bonding film 15 interposed. A method for bonding the nozzle plate 80 and the substrate 20 will be described in detail below.

[2A] Energy is first applied to the bonding film 15 of the nozzle plate 80.

When energy is applied, the elimination groups 303 are eliminated from the Si skeleton 301 in the bonding film 15 in the same manner as the base film 141 described above, as shown in FIG. 4. After the elimination groups 303 are eliminated, the activation hands 304 are produced on the surface and the inside of the bonding film 15. Thereby, adhesiveness with respect to the substrate 20 is developed on the surface of the bonding film 15.

Here, the energy may be applied to the bonding film 15 by the same method for applying energy to the base film 141 described above. Especially, the energy is preferably applied to the bonding film 15 by the energy beam irradiation method described above.

According to the method of irradiating the bonding film 15 with an energy beam, energy can be efficiently applied to the bonding film 15 of the nozzle plate 80, being able to efficiently develop adhesiveness on the bonding film 15.

Among the energy beams mentioned above, especially ultraviolet light having a wavelength of about 150 nm to about 300 nm is preferably adopted as is the case with the energy beam irradiation to the base film 141 described above (refer to FIG. 10A). According to the ultraviolet light, an amount of energy to be applied is optimized, so that the Si skeleton 301 in the bonding film 15 is prevented from being excessively destroyed, and bonds between the Si skeleton 301 and the elimination groups 303 can be selectively cleaved. Accordingly, adhesiveness can be developed on the bonding film 15 without degrading of properties (a mechanical property, a chemical property, and the like) of the bonding film 15.

Further, according to the energy beam irradiation method, an amount of energy to be applied can be precisely adjusted with ease, enabling an adjustment of an eliminating amount of the elimination groups 303 eliminated from the bonding film 15. Thus, the bonding strength between the bonding film 15 and the substrate 20 can be easily controlled by adjusting the eliminating amount of the elimination groups 303.

That is, by increasing the eliminating amount of the elimination groups 303, more activation hands are produced on the surface and the inside of the bonding film 15, whereby adhesiveness developed on the bonding film 15 can be increased. On the other hand, by reducing the eliminating amount of the elimination groups 303, activation hands produced on the surface and the inside of the bonding film 15 are reduced, whereby adhesiveness developed on the bonding film 15 can be suppressed.

Here, the amount of energy to be applied can be adjusted by adjusting conditions such as a kind of the energy beam, output of the energy beam, and irradiation time of the energy beam.

According to the energy beam irradiation method, a large amount of energy can be applied in a short period of time. Thus, the energy can be efficiently applied.

In application of energy to the bonding film 15 by the heating method described above, the bonding film 15 may be heated under the conditions described above in a case where thermal expansion coefficients of the nozzle plate body 10 and the substrate 20 are approximately same. However, in a case where the thermal expansion coefficients of the nozzle plate body 10 and the substrate 20 are different from each other, the nozzle plate body 10 and the substrate 20 are preferably bonded to each other at a temperature as low as possible, as described in detail later. Bonding at low temperature further reduces thermal stress occurring at a bonding interface.

In the embodiment, energy is applied to the bonding film 15 before the nozzle plate body 10 and the substrate 20 are bonded. However, the energy application can be conducted after the nozzle plate 80 and the substrate 20 are layered. That is, the nozzle plate 80 and the substrate 20 are layered so as to firmly contact the bonding film 15 and the substrate 20 before energy is applied to the bonding film 15 of the nozzle plate 80, forming a provisional bonded body. Then energy is applied to the bonding film 15 of the provisional bonded body so as to develop adhesiveness of the bonding film 15. Thus the nozzle plate 80 and the substrate 20 are bonded (adhesively bonded) to each other with the bonding film 15 interposed.

In this case, the energy can be applied to the bonding film 15 of the provisional bonded body by the methods (I) and (II) described above, but energy may be applied by a method (III) in which compressive force is applied to the bonding film 15.

In the method (III), the bonding film 15 is compressed preferably by pressure of approximately from 0.2 MPa to 10 MPa in an approaching direction of the nozzle plate 80 and the substrate 20, more preferably by pressure of approximately from 1 MPa to 5 MPa. Accordingly, only by compressing, appropriate energy can be easily applied to the bonding film 15 and sufficient adhesiveness of the bonding film 15 is developed. This pressure can excess the upper limit of the above range, but the bonded body 90 and the nozzle plate body 10 may be disadvantageously damaged depending on constituent materials of the nozzle plate body 10 and the bonded body 90.

The time for applying compressive force is not particularly limited. However, it is preferably be approximately from 10 seconds to 30 minutes. The time for applying compressive force may be arbitrarily changed based on magnitude of compressive force. Concretely, as the magnitude of compressive force is increased, the time for applying compressive force can be shortened.

Here, the nozzle plate 80 and the substrate 20 are not bonded with each other in the state of the provisional bonded body, so that the relative position of them can be easily adjusted (shifted). Therefore, by slightly adjusting the relative position of the nozzle plate 80 and the substrate 20 after the provisional bonded body is obtained once, assembling accuracy (higher dimensional accuracy) of the head 1 that is finally obtained can be securely improved.

By the above method, energy can be applied to the bonding film 15.

Here, energy can be applied to the whole surface of the bonding film 15, but also may be applied only to part of the bonding film 15. In this case, a region in which adhesiveness of the bonding film 15 is developed can be controlled. Therefore, local concentration of stress generated at a bonding interface can be suppressed by appropriately adjusting an area and a shape of the region. Accordingly, the nozzle plate body 10 and the substrate 20 can be securely bonded to each other even in a case where they have thermal expansion coefficients that are largely different from each other.

As described above, the bonding film 15 in a state before energy is applied thereto has the Si skeleton 301 and the elimination groups 303 as shown in FIG. 4. When energy is applied to the bonding film 15 in such state, the elimination groups 303 (methyl groups in the embodiment) are eliminated from the Si skeleton 301. Thereby, the activation hands 304 are produced on a surface 155 of the bonding film 15, activating the surface 151. As a result, adhesiveness is developed on the surface of the bonding film 15, whereby the nozzle plate 80 can be especially strongly bonded with the substrate 20.

Figure 10A:
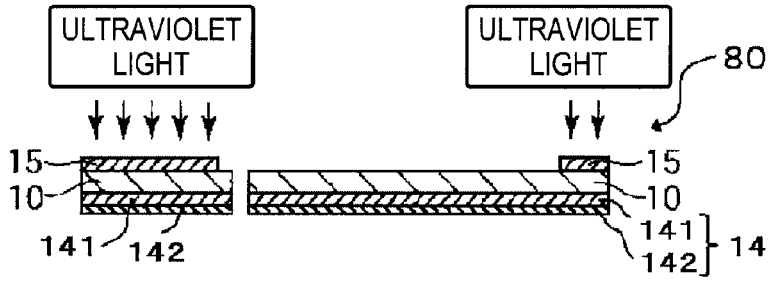
FIGS. 10A to 10C are diagrams (longitudinal sectional views) for explaining the method for manufacturing an ink-jet type recording head.
Figure 10B:
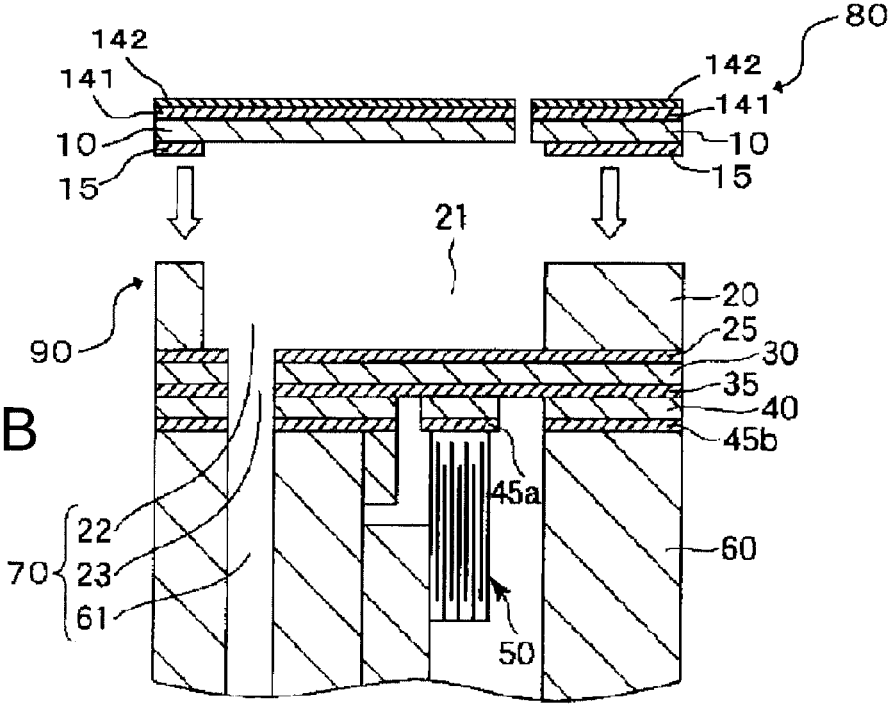
Figure 10C:
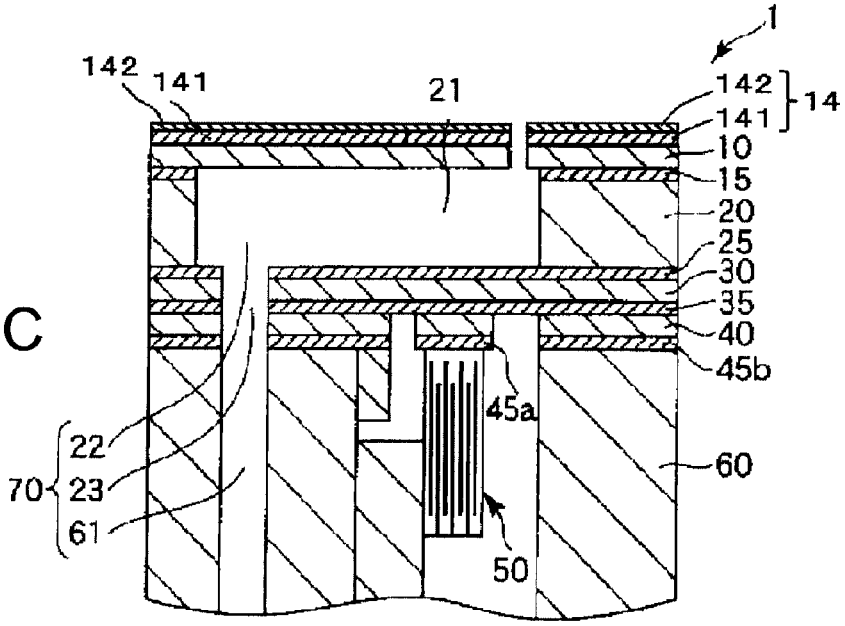

[2B] As shown in FIG. 10B, the nozzle plate 80 and the substrate 20 are laminated together so as to tightly contact the bonding film 15 on which adhesiveness is developed and the substrate 20 of the bonded body 90. Accordingly, the head 1 in which the nozzle plate 80 and the substrate 20 are bonded (adhesively bonded) to each other with the bonding film 15 interposed is obtained as shown in FIG. 10C. In the head 1 obtained as this, the nozzle plate body 10 and the substrate 20 are bonded to each other with high dimensional accuracy, whereby the head 1 is capable of performing high quality printing. Further, heads 1 which are manufactured by the above method have suppressed variation in printing qualities each other.

Here, the nozzle plate body 10 and the substrate 20 that are bonded as above preferably have nearly same thermal expansion coefficients as each other. When the nozzle plate body 10 and the substrate 20 that have nearly same thermal expansion coefficients are bonded to each other, stress corresponding to thermal expansion is hardly generated at a bonding interface of them. This can ensure prevention of defects such as separation in the head 1 which is finally obtained.

Further, even if the nozzle plate body 10 and the substrate 20 have the thermal expansion coefficients which are different from each other, the nozzle plate 80 and the substrate 20 can be strongly bonded to each other in high dimensional accuracy by optimizing conditions in bonding the nozzle plate 80 and the substrate 20 as the following description.

That is, in a case where the nozzle plate body 10 and the substrate 20 have the thermal expansion coefficients which are different from each other, it is preferable that the bonding be conducted at a temperature as low as possible. Bonding at low temperature further reduces thermal stress occurring at a bonding interface.

Concretely, though it depends on the difference between the thermal expansion coefficients of the nozzle plate body 10 and the substrate 20, the nozzle plate 80 and the substrate 20 are bonded preferably in a state that temperatures of the nozzle plate body 10 and the substrate 20 are in a range approximately from 25° C. to 50° C., more preferably in a range approximately from 25° C. to 40° C. In such temperature range, thermal stress occurred at the bonding interface can be sufficiently reduced even if difference between the thermal expansion coefficients of the nozzle plate body 10 and the substrate 20 is large to some extent. Thereby, warpage, separation, or the like in the head 1 can be securely prevented.

In this case, in a case where difference between thermal expansion coefficients of the nozzle plate body 10 and the substrate 20 is $5\times10^{-5}$/K or more, the nozzle plate 80 and the substrate 20 are especially recommended to be bonded at a temperature as low as possible as describe above. Here, by using the bonding film 15, the nozzle plate body 10 and the substrate 20 can be strongly bonded to each other even at the low temperature mentioned above.

Further, the nozzle plate body 10 and the substrate 20 preferably have different rigidity from each other. Accordingly, the nozzle plate body 10 and the substrate 20 can be further strongly bonded to each other.

It is preferable that a surface treatment be performed on a region, which is to contact with the bonding film 15, of the substrate 20 so as to enhance adhesion property with respect to the bonding film 15. The treatment can further improve the bonding strength between the substrate 20 and the bonding film 15.

The surface treatment may be the same as the above mentioned treatment performed on the base member 10' of the nozzle plate body 10.

Alternatively, instead of the surface treatment, it is preferable that an intermediate layer enhancing adhesion property of the substrate 20 with respect to the bonding film 15 be formed in advance in the region, which contacts with the bonding film 15, of the substrate 20. The treatment can further improve the bonding strength between the substrate 20 and the bonding film 15.

The intermediate layer may be made of the same material as the constituent material of the intermediate layer formed on the base member 10' mentioned above.

Needless to say, a surface treatment and formation of an intermediate layer, which are like ones conducted with respect to the substrate 20 as described above, may be conducted with respect to the sealing sheet 30, the vibrating plate 40, the piezoelectric element 50, and the case head 60. This can further improve bonding strength between respective components.

Mechanism by which the nozzle plate 80 having the bonding film 15 and the substrate 20 are bonded to each other will now be described.

A case where hydroxyl groups are exposed at a region, which contacts to be bonded with the nozzle plate 80 (the nozzle plate body 10), of the substrate 20 will be described as an example. When the nozzle plate 80 and the substrate 20 are laminated together so as to contact the bonding film 15 and the substrate 20, hydroxyl groups existing at the surface of the bonding film 15 and hydroxyl groups existing at the above-mentioned region of the substrate 20 attract each other by hydrogen bond, generating attractive force between the hydroxyl groups. It is inferred that the nozzle plate 80 having the bonding film 15 and the substrate 20 are bonded to each other by the attractive force.

Further, the hydroxyl groups attracting each other by the hydrogen bond are dehydrated and condensed depending on a temperature condition and the like. As a result, bonding hands to which hydroxyl groups are bonded are bonded to each other in a manner to interpose oxygen atoms, at a contacting interface of the bonding film 15 and the substrate 20. Accordingly, it is inferred that the nozzle plate 80 and the substrate 20 are further strongly bonded to each other with the bonding film 15 interposed.

Here, the activated state of the surface of the bonding film 15 activated in the step [2A] above is temporally reduced. Therefore, the present step [2B] is preferably performed as soon as possible after completion of the previous step [2A]. Specifically, the step [2B] is preferably performed within 60 minutes after the completion of the step [2A], more preferably within 5 minutes. The surface of the bonding film 15 sufficiently keeps activated state within the periods of time, so that sufficient bonding strength can be obtained between the nozzle plate 80 and the substrate 20 when the nozzle plate 80 having the bonding film 15 and the substrate 20 are bonded to each other in the present step.

The bonding strength between the nozzle plate body 10 and the substrate 20 that are bonded to each other as above is preferably 5 MPa (50 kgf/cm$^2$) or more, more preferably 10 MPa (100 kgf/cm$^2$) or more. With such bonding strength, separation at the bonding interface can be sufficiently prevented. Accordingly, the head 1 having high reliability can be obtained.

Through the above-described steps, the head 1 is manufactured.

Further, a plasma polymerized film may be formed in a region, which is to contact with the nozzle plate 80, of the substrate 20 as well. That is, the plasma polymerized films are formed on both of the nozzle plate body 10 and the substrate 20.

Third Embodiment

Figure 12:
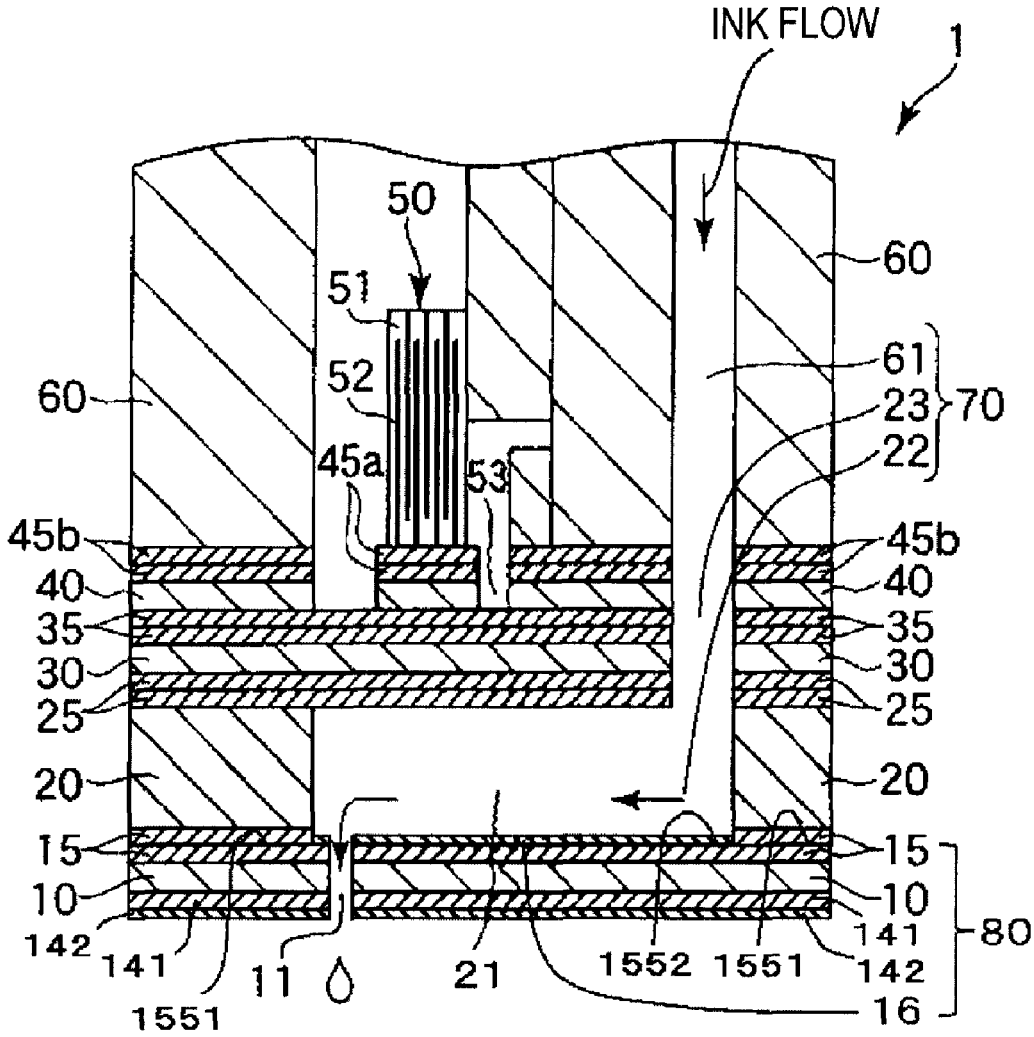
FIG. 12 is a sectional view showing another structural example of an ink-jet type recording head of an embodiment.

FIG. 12 is a diagram showing another structural example of a head of the embodiment. In the following description, the upper side in FIG. 12 is described as "upper", while the lower side is described as "lower".

In this head 1 shown in FIG. 12, the nozzle plate 80 and the substrate 20 are laminated together so as to tightly contact a bonding film 15 formed on the upper surface of the nozzle plate 80 and a bonding film 15 formed on the lower surface of the substrate 20, thus bonding (adhesively bonding) the nozzle plate 80 and the substrate 20.

In the similar manner, the substrate 20 and the sealing sheet 30 are laminated together in the head 1 shown in FIG. 12 so as to tightly contact a bonding film 25 formed on the upper surface of the substrate 20 and a bonding film 25 formed on the lower surface of the sealing sheet 30, thus bonding (adhesively bonding) the substrate 20 and the sealing sheet 30.

Further, the sealing sheet 30 and the vibrating plate 40 are laminated together so as to tightly contact a bonding film 35 formed on the upper surface of the sealing sheet 30 and a bonding film 35 formed on the lower surface of the vibrating plate 40, thus bonding (adhesively bonding) the sealing sheet 30 and the vibrating plate 40.

Further, the vibrating plate 40 and the piezoelectric element 50 are brought together so as to tightly contact a bonding film 45*a* formed on the upper surface of the vibrating plate 40 and a bonding film 45*a* formed on the lower surface of the piezoelectric element 50, thus bonding (adhesively bonding) the vibrating plate 40 and the piezoelectric element 50.

Furthermore, the vibrating plate 40 and the case head 60 are brought together so as to tightly contact a bonding film 45*b* formed on the upper surface of the vibrating plate 40 and a bonding film 45*b* formed on the lower surface of the case head 60, thus bonding (adhesively bonding) the vibrating plate 40 and the case head 60.

Here, in the present structural example, the bonding films 25, the bonding films 35, the bonding films 45*a*, and the bonding films 45*b* are plasma polymerized films that are similar to the bonding films 15.

In the head 1 having such structure, interfaces of respective components can be further strongly bonded to each other. Further, a material of an attached body (for example, the substrate, the nozzle plate, the sealing sheet, the vibrating plate, the piezoelectric element, the case head, and the like) of the head 1 hardly influences the bonding strength. Therefore, such reliable head 1 that respective components thereof are strongly bonded to each other can be obtained.

In this case, energy application is conducted to each of the bonding film 15 of the nozzle plate 80 and the bonding film 15 formed on the lower surface of the substrate 20, for example.

Further, in the nozzle plate 80 of the head 1 of the present embodiment, the bonding film 15 that is the plasma polymerized film described above is formed on the whole surface, which faces the substrate 20, of the nozzle plate body 10 as shown in FIG. 12. Further, on a region (non-bonding region) 1552, which is not bonded to the substrate 20, of the bonding film 15, a monomolecular film 16 made of the coupling agent is formed.

The monomolecular film 16 is formed such that the coupling agent is bonded with the non-bonding region 1552 of the bonding film 15 due to reactivity developed by applying energy to the bonding film 15. As the coupling agent from which the monomolecular film 16 is made, a coupling agent including a functional group having lyophilic property with respect to an ink is used.

In the head 1 having such the structure, even if the nozzle plate body 10 is made of a material which has poor lyophilic property with respect to the ink, lyophilic property of the liquid storage chambers 21 of the head 1 is improved, being able to stably discharge droplets from the nozzle 11.

In the head 1 of the embodiment, the monomolecular film 16 is formed on the non-bonding region 1552 of the bonding film 15. However, lyophilic property in the liquid storage chambers 21 of the head 1 can be improved without forming the monomolecular film 16 depending on characteristics of the ink which is used and characteristics of the plasma polymerized film constituting the bonding film 15.

That is, in a case where an ink to be used is an oil-based ink and the plasma polymerized film constituting the bonding film 15 is made of a material including alkyl groups as elimination groups (for example, polyorganosiloxane described above), the bonding film 15 has high lyophilic (oleophilic) property with respect to the ink. As a result, the lyophilic property in the liquid storage chambers 21 is improved, being able to improve the discharge stability of the head 1. In a case where an ink to be used is a water-based ink and the bonding film 15 having the above-described structure is formed on the whole surface, which faces the substrate 20, of the nozzle plate 80, a region, which contacts with the ink, of the bonding film 15 obtains high lyophilic property with respect to the ink by applying energy to the whole surface of the bonding film 15. As a result, the discharge stability of the head 1 can be further improved. Further, such the plasma polymerized film has excellent alkaline resistance. Therefore, in a case where the ink used in the head 1 of the present embodiment is alkaline, the plasma polymerized film formed on a region 1512, which contacts with the ink, of the nozzle plate body 10 functions as a protection film of the nozzle plate body 10, thus enhancing reliability of the nozzle plate 80 and further, reliability of the head 1.

After obtaining the head 1, according to need, at least one step (step of further improving the bonding strength of the head 1) of the following two steps 3A and 3B may be performed with respect to the head 1. Accordingly, the bonding strength of respective components of the head 1 can be further improved.

[3A] The head 1 which is obtained is compressed, that is, pressurized in a direction in which the nozzle plate 80, the substrate 20, the sealing sheet 30, the vibrating plate 40, and the case head 60 come closer to each other.

Accordingly, surfaces of respective components and surfaces of respective bonding films adjacent to the components get closer, enhancing the bonding strength in the head 1.

Additionally, by pressurizing the head 1, gaps remaining at the bonding interfaces in the head 1 are squashed, further enlarging the bonding area. Thus, the bonding strength in the head 1 is furthermore improved.

Here, the head 1 is preferably pressurized by pressure as high as possible at an extent that the head 1 is not damaged. The bonding strength in the head 1 can be increased in proportion to the pressure.

The pressure may be arbitrarily adjusted depending on the material and the thickness of each of the components of the head 1 and conditions of a bonding device. Specifically, though it slightly changes depending on the above conditions, the pressure is preferably in a range approximately from 0.2 MPa to 10 MPa, more preferably in a range approximately from 1 MPa to 5 MPa. Accordingly, the bonding strength in the head 1 is securely enhanced. Though the pressure may excess an upper limit of the above range, the head 1 may be disadvantageously damaged depending on the material of the each of the components of the head 1.

Though pressurizing time is not particularly limited, it may be preferably in a range approximately from 10 seconds to 30 minutes. In addition, the pressurizing time may be appropriately changed depending on pressure to be applied. Specifically, as the pressure applied to the head 1 is increased, the bonding strength in the head 1 can be enhanced even if the pressurizing time is reduced.

[3B] The head which is obtained is heated.

Accordingly, the bonding strength in the head 1 can be further improved.

At this time, a temperature for heating the head 1 is not specifically limited as long as the temperature is higher than room temperature and lower than an upper temperature limit of the head 1. However, the heating temperature is preferably in a range approximately from 25° C. to 100° C., more preferably in a range approximately from 50° C. to 100° C. Heating the head 1 at the temperature in the above range can securely prevent alteration and deterioration, which are caused by heat, of the head 1 and also can securely enhance the bonding strength.

The heating time is not particularly limited, but it may be preferably in a range approximately from 1 minute to 30 minutes.

Additionally, in a case where the steps [3A] and [3B] are both performed, these steps are preferably performed at one time. That is, the head 1 is preferably heated in a pressurized manner. Accordingly, an advantageous effect in pressurizing and an advantageous effect in heating are synergistically exerted, whereby the bonding strength in the head 1 is highly improved.

Through the steps above, the head 1 can be easily formed to have further improved bonding strength.

Hereinabove, the nozzle plate, the method for manufacturing a nozzle plate, the droplet discharge head, the method for manufacturing a droplet discharge head, and the droplet discharge device have been described based on the embodiments of the invention shown in the drawings, but the invention is not limited to these embodiments.

For example, the method for manufacturing a droplet discharge head is not limited to the above embodiment, but may have a different processing order. Further, one or more of arbitrary steps may be added and unnecessary steps may be omitted.

The nozzle plate 80 has the liquid-repellent film 14 on the whole surface, which is an opposite surface of a surface facing the substrate 20, of the nozzle plate body 10 in the embodiments, but the liquid-repellent film 14 may be formed at least a periphery of the nozzle 11.

Furthermore, formation of at least one bonding film among the bonding film 25, the bonding film 35, the bonding film 45*a*, and the bonding film 45*b* can be omitted. In this case, components, which are bonded to each other in a manner interposing each bonding film in the embodiment, can be bonded (adhesively bonded) to each other by fusion bonding (welding), or a direct bonding method such as silicon direct bonding and solid bonding such as anodic bonding.

Further, the bonding method using the bonding film may be employed for bonding components other than the above described components of the droplet discharge head.

WORKING EXAMPLE

Specific examples of the invention will now be described.

1. Manufacture of Ink-Jet Type Recording Head

EXAMPLE

<1> A first base member made of stainless steel, a second base member made of single crystal silicon and having a plate shape, a sealing sheet made of polyphenylene sulfide (PPS), a vibrating plate made of stainless steel, a piezoelectric element which is a layered body of a piezoelectric layer composed of a sintered body of lead zirconate and an electrode film obtained by sintering an Ag paste, and a case head made of PPS were first prepared.

Then, the first base member was housed in the chamber of the plasma polymerization device shown in FIG. 11 and a surface treatment using oxygen plasma was conducted.

Subsequently, plasma polymerized films (bonding films) having an average thickness of 200 nm were formed on the surfaces, on which the surface treatment had been conducted, of the first base member. Conditions for the film formation are shown below.

Film-Formation Conditions

Composition of raw gas: octamethyltrisiloxane
Flow rate of raw gas: 10 sccm
Composition of carrier gas: argon
Flow rate of carrier gas: 10 sccm
Output of high frequency power: 100 W
Pressure within chamber: 1 Pa (low-vacuum)
Treatment time: 15 minutes
Substrate temperature: 20° C.

The plasma polymerized films thus formed on the both surfaces of the first base member were composed of a polymeric substance of octamethyltrisiloxane (raw gas) and had a Si skeleton including siloxane bonds and having a random atomic structure, and alkyl groups (elimination groups).

Then, the plasma polymerized film formed on one surface of the first base member was irradiated with ultraviolet light under the following conditions.

Ultraviolet Light Irradiation Conditions

Composition of atmospheric gas: atmosphere (air)
Temperature of atmospheric gas: 20° C.
Pressure of atmospheric gas: atmospheric pressure (100 kPa)
Wavelength of ultraviolet light: 172 nm
Irradiation time of ultraviolet light: 5 minutes For the plasma polymerized film which had been irradiated with the ultraviolet light under the above conditions, a process solution was prepared by dissolving a coupling agent ("OPTOOL" produced by Daikin Industries, Ltd.) having liquid repellency in hydrofluoroether (HFE) ("NOVEC" produced by Sumitomo 3M Ltd.) to have a concentration of 0.1 wt %.

Subsequently, the first base member on which the plasma polymerized films had been formed was immersed in the process solution and pulled out at a constant speed so as to form a monomolecular film made of the silane coupling agent on the surface of the plasma polymerized film, which had been irradiated with ultraviolet light, of the first base member.

Process conditions for forming the monomolecular film were as described below.

Temperature of process solution: 25° C.
Immersing time: 0.1 seconds to 180 seconds
Pulling out speed: 0.5 mm/sec to 50 mm/sec Then, a nozzle was formed by etching on the first base member provided with the plasma polymerized films on both surfaces and provided with the monomolecular film made of the silane coupling agent. Thus, a nozzle plate was obtained.

<2> Then, a plasma polymerized film was formed on one surface of the second base member in the similar manner to the step <1> above.

Then the plasma polymerized film was irradiated with ultraviolet light in the similar manner to the step <1>.

Meanwhile, a surface treatment using oxygen plasma was conducted with respect to one surface of the sealing sheet.

One minute after the ultraviolet light irradiation, the second base member and the sealing sheet were laminated together so as to contact the surface, which had been irradiated with the ultraviolet light, of the plasma polymerized film and the surface, which had been subjected to the surface treatment, of the sealing sheet. Thus, a bonded body composed of the second base member and the sealing sheet was obtained.

<3> A plasma polymerized film was formed on the sealing sheet of the bonded body composed of the second base member and the sealing sheet, in the similar manner to the step <1> above.

Then, the plasma polymerized film that had been obtained was irradiated with ultraviolet light in the similar manner to the step <1>. Meanwhile, a surface treatment using oxygen plasma was conducted with respect to one surface of the vibrating plate.

One minute after the ultraviolet light irradiation, the bonded body and the vibrating plate were brought together so as to contact the surface, which had been irradiated with the ultraviolet light, of the plasma polymerized film and the surface, which had been subjected to the surface treatment, of the vibrating plate. Thus, a bonded body of the second base member, the sealing sheet, and the vibrating plate was obtained.

<4> A through hole was formed at a position, which corresponded to a position on which a liquid supply chamber was to be formed, of the sealing sheet, the vibrating plate, and the plasma polymerized films that were adjusted to the sealing sheet and the vibrating plate. Further, a through hole was formed at a circular region, surrounding a position on which the piezoelectric element 50 was to be formed, of the vibrating plate 40. These through holes ware formed by etching.

<5> A plasma polymerized film was formed at a position, on which the piezoelectric element was to be formed, of the vibrating plate of the bonded body obtained by bonding the second base member, the sealing sheet, and the vibrating plate (a region at an internal side of the circular through hole), in the similar manner to the step <1> above.

Then, the plasma polymerized film that had been obtained was irradiated with ultraviolet light in the similar manner to the step <1>. Meanwhile, a surface treatment using oxygen plasma was conducted with respect to one surface of the piezoelectric element.

One minute after the ultraviolet light irradiation, the bonded body and the piezoelectric element were brought together so as to contact the surface, which had been irradiated with the ultraviolet light, of the plasma polymerized film and the surface, which had been subjected to the surface treatment, of the piezoelectric element. Thus, a bonded body composed of the second base member, the sealing sheet, the vibrating plate, and the piezoelectric element was obtained.

<6> A plasma polymerized film was formed at a position, on which the case head was to be formed, of the bonded body obtained by bonding the second base member, the sealing sheet, the vibrating plate, and the piezoelectric element, in the similar manner to the step <1> above.

Then, the plasma polymerized film that had been obtained was irradiated with ultraviolet light in the similar manner to the step <1>. Meanwhile, a surface treatment using oxygen plasma was conducted with respect to the bonding surface of the case head.

One minute after the ultraviolet light irradiation, the bonded body and the case head were brought together so as to contact the surface, which had been irradiated with the ultraviolet light, of the plasma polymerized film and the surface, which had been subjected to the surface treatment, of the case head. Thus, a bonded body composed of the second base member, the sealing sheet, the vibrating plate, the piezoelectric element, and the case head was obtained.

<7> The bonded body that had been obtained was inverted upside down, and a surface, which was an opposite surface to a surface bonded to the sealing sheet, of the second base member was processed by etching. Thus liquid storage chambers and a liquid supply chamber were formed on the second base member. Thereby, a liquid storage chamber forming substrate was obtained.

<8> One plasma polymerized film of the plasma polymerized films formed on both surfaces of the nozzle plate was irradiated with ultraviolet light in the similar manner to the step <1> above. Meanwhile, a surface treatment using oxygen plasma was conducted with respect to the bonding surface of the liquid storage chamber forming substrate.

One minute after the ultraviolet light irradiation, the liquid storage chamber forming substrate and the nozzle plate were laminated together so as to contact the surface, which had been irradiated with the ultraviolet light, of the plasma polymerized film and the surface, which had been subjected to the surface treatment, of the liquid storage chamber forming substrate. Consequently, a bonded body composed of the nozzle plate (the first base member), the second base member, the sealing sheet, the vibrating plate, the piezoelectric element, and the case head, namely, an ink-jet type recording head was obtained.

<9> The ink-jet type recording head that had been obtained was heated at a temperature of 80° C. while being compressed at 3 MPa for 15 minutes. Thus, the bonding strength of the ink-jet type recording head was improved.

COMPARATIVE EXAMPLE

An ink-jet type recording head was manufactured in the same manner as above example except for bonding all of bonding parts with an epoxy adhesive. The all of the bonding parts were between a nozzle plate and a liquid storage chamber forming substrate, between a base member and a sealing sheet, between the sealing sheet and a vibrating plate, between the vibrating plate and a piezoelectric element, and between the vibrating plate and a case head.

2. Evaluation of Ink-Jet Type Recording Head 2.1 Evaluation of Dimensional Accuracy Dimensional accuracy of the ink-jet type recording heads obtained in the example and the comparative example were measured.

As a result, the ink-jet type recording head obtained in the example had more excellent dimensional accuracy than the ink-jet type recording head obtained in the comparative example.

Further, each of the ink-jet type recording heads was set in an ink-jet printer and printing was conducted on a printing paper. As a result, the printer in which the head obtained in the example had been set exhibited higher printing quality than the printer in which the head obtained in the comparative example had been set.

2.2 Evaluation of Chemical Resistance

The ink-jet type recording heads obtained in the example and the comparative example were filled with ink-jet printer ink (product of Epson) which was maintained at a temperature of 80° C., and were left for three weeks in that manner. Then states of the ink-jet type recording heads were evaluated.

As a result, almost no infiltration of the ink was recognized in the ink-jet type recording head obtained in the example. In contrast, infiltration of the ink was recognized in the ink-jet type recording head obtained in the comparative example.

What is claimed is:

1. A nozzle plate, comprising:

a nozzle for discharging a liquid as droplets;

a liquid-repellent film suppressing attachment of the droplets on one surface of the nozzle plate; and a first bonding film formed on the other surface of the nozzle plate and bonded with a substrate, wherein the liquid-repellent film includes a first plasma polymerized film having a Si skeleton, the Si skeleton including a siloxane (Si—O) bond and having a random atomic structure, and an elimination group bonded with the Si skeleton, wherein the elimination group existing around a surface of the first plasma polymerized film is eliminated from the Si skeleton by applying energy to a region of at least a part of the first plasma polymerized film so as to generate reactivity, on the region of the first plasma polymerized film, with a coupling agent having liquid repellency with respect to the droplets, and the first plasma polymerized film is bonded with the coupling agent by the reactivity so as to form the liquid-repellent film, wherein the first bonding film is a second plasma polymerized film having a Si skeleton, the Si skeleton including a siloxane (Si—O) bond and having a random atomic structure, and an elimination group bonded with the Si skeleton, and wherein the elimination group existing around a surface of the second plasma polymerized film constituting the first bonding film is eliminated from the Si skeleton by applying energy to a region of at least a part of the second polymerized film, so as to develop in the region of the surface of the second polymerized film adhesiveness with respect to the substrate.

2. The nozzle plate according to claim 1, wherein a sum of a content of a Si atom and a content of an O atom in whole atoms constituting the first and second plasma polymerized films excluding a H atom is from 10 atomic % to 90 atomic %.

3. The nozzle plate according to claim 1, wherein an abundance ratio between the Si atom and the O atom in the first and second plasma polymerized films is from 3:7 to 7:3.

4. The nozzle plate according to claim 1, wherein crystallinity of the Si skeleton is equal to or less than 45%.

5. The nozzle plate according to claim 1, wherein the first and second plasma polymerized films include a Si—H bond.

6. The nozzle plate according to claim 5, wherein when peak intensity attributed to the siloxane bond is set to be 1 in infrared absorbing spectrum of the first and second plasma polymerized films including the Si—H bond, peak intensity attributed to the Si—H bond is from 0.001 to 0.2.

7. The nozzle plate according to claim 1, wherein the elimination group is at least one selected from a H atom, a B atom, a C atom, a N atom, an O atom, a P atom, a S atom, a halogen atom, and an atom group including these atoms that are arranged so as to be bonded with the Si skeleton.

8. The nozzle plate according to claim 7, wherein the elimination group is an alkyl group.

9. The nozzle plate according to claim 8, wherein when peak intensity attributed to the siloxane bond is set to be 1 in infrared absorbing spectrum of the first and second plasma polymerized films including a methyl group as the elimination group, peak intensity attributed to the methyl group is from 0.05 to 0.45.

10. The nozzle plate according to claim 1, wherein the first and second plasma polymerized films are mainly made of polyorganosiloxane.

11. The nozzle plate according to claim 10, wherein polyorganosiloxane mainly contains a polymeric substance of octamethyltrislioxane.

12. The nozzle plate according to claim 1, wherein an average thickness of the first and second plasma polymerized films is from 1 nm to 1000 nm.

13. The nozzle plate according to claim 1, wherein the coupling agent is a silane coupling agent including a functional group having liquid repellency.

14. The nozzle plate according to claim 1, wherein the nozzle plate is mainly made of one of a silicon material and stainless steel.

15. A method for manufacturing the nozzle plate of claim 1, comprising:

a) forming the first and a second plasma polymerized films having the Si skeleton, the Si skeleton including the siloxane (Si—O) bond and having the random atomic structure, and the elimination group bonded with the Si skeleton, on both surfaces of a plate-like base member by employing a plasma polymerization method;

b) applying energy to the first plasma polymerized film formed on one surface of the base member, so as to develop reactivity with the coupling agent on the surface of the first plasma polymerized film formed on the one surface of the base member;

c) bonding the coupling agent with the first plasma polymerized film formed on the one surface of the base member; and d) forming a nozzle penetrating through the base member and the first and second plasma polymerized films.

16. The method for manufacturing the nozzle plate according to claim 15, wherein the first and second plasma polymerized films are simultaneously formed on the both surfaces of the base member.

17. The method for manufacturing the nozzle plate according to claim 15, wherein the first plasma polymerized film that is formed on the one surface of the base member is immersed in a solution containing the coupling agent so as to bond the coupling agent with the one surface of the first plasma polymerized film.

18. The method for manufacturing the nozzle plate according to claim 15, wherein an output density of high frequency power in generation of plasma by the plasma polymerization method is from 0.01 $W/cm^2$ to 100 $W/cm^2$.

19. The method for manufacturing the nozzle plate according to claim 15, wherein the application of energy is conducted by irradiating the first and second plasma polymerized films with an energy beam.

20. The method for manufacturing the nozzle plate according to claim 19, wherein the energy beam is ultraviolet light having a wavelength from 126 nm to 300 nm.

21. The method for manufacturing the nozzle plate according to claim 15, wherein a surface treatment for enhancing adhesion property with respect to the first and second plasma polymerized films is performed in advance on regions on which the first and second plasma polymerized films are formed of the base member.

22. The method for manufacturing the nozzle plate according to claim 21, wherein the surface treatment is a plasma treatment.

23. A droplet discharge head, comprising:

the nozzle plate of claim 1; and a bonded body obtained by bonding a substrate on which a liquid storage chamber for storing the liquid is formed and a sealing plate formed to cover the liquid storage chamber, wherein the elimination group existing around the surface of the first bonding film is eliminated from the Si skeleton by applying energy to a region of at least a part of the first bonding film formed on one surface of the nozzle plate, so as to develop adhesiveness at the region of the surface of the first bonding film, and by the adhesiveness, the nozzle plate and the substrate of the bonded body are bonded to each other with the first bonding film interposed.

24. The droplet discharge head according to claim 23, wherein the bonded body is obtained by bonding the substrate and the sealing plate in a manner to interpose a second bonding film similar to the first bonding film.

25. The droplet discharge head according to claim 23, wherein the sealing plate is a layered body obtained by layering a plurality of layers, and at least one pair of adjacent layers among the layers of the layered body are bonded to each other in a manner to interpose a third bonding film similar to the first bonding film on which the adhesiveness is developed.

26. The droplet discharge head according to claim 23, further comprising:

a vibrating unit vibrating the sealing plate and formed on a surface, the surface being opposite to a surface facing the substrate, of the sealing plate, wherein the sealing plate and the vibrating unit are bonded to each other in a manner to interpose a fourth bonding film similar to the first bonding film on which the adhesiveness is developed.

27. The droplet discharge head according to claim 26, wherein the vibrating unit is a piezoelectric element.

28. The droplet discharge head according to claim 23, further comprising:

a case head formed on the surface, the surface being opposite to the surface facing the substrate, of the sealing plate, wherein the sealing plate and the case head are bonded to each other in a manner to interpose a fifth bonding film similar to the first bonding film on which the adhesiveness is developed.

29. A droplet discharge device provided with the droplet discharge head of claim 23.

* * * * *